US009189992B2

(12) United States Patent
Hwang et al.

(10) Patent No.: US 9,189,992 B2
(45) Date of Patent: Nov. 17, 2015

(54) PIXEL, DISPLAY DEVICE COMPRISING THE SAME AND DRIVING METHOD THEREOF

(71) Applicant: Samsung Display Co., Ltd., Yongin, Gyeonggi-do (KR)

(72) Inventors: Young-In Hwang, Yongin (KR); Young-Jin Cho, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 95 days.

(21) Appl. No.: 14/029,686

(22) Filed: Sep. 17, 2013

(65) Prior Publication Data

US 2014/0347401 A1 Nov. 27, 2014

(30) Foreign Application Priority Data

May 27, 2013 (KR) ..... 10-2013-0059847

(51) Int. Cl.
*G09G 3/32* (2006.01)

(52) U.S. Cl.
CPC ..... *G09G 3/3233* (2013.01); *G09G 2300/043* (2013.01); *G09G 2300/0413* (2013.01); *G09G 2300/0819* (2013.01); *G09G 2300/0852* (2013.01); *G09G 2330/08* (2013.01)

(58) Field of Classification Search
CPC ..... G09G 3/3233; G09G 2330/08; G09G 2330/10; H01L 2251/56; H01L 2251/568; H01L 27/3244; H01L 27/3276
USPC ..... 345/76, 80, 82
See application file for complete search history.

(56) References Cited

U.S. PATENT DOCUMENTS

| | | | | |
|---|---|---|---|---|
| 2004/0188681 | A1* | 9/2004 | Lai | 257/59 |
| 2008/0001869 | A1* | 1/2008 | Chung et al. | 345/87 |
| 2008/0036797 | A1* | 2/2008 | Whang | 345/698 |
| 2008/0068324 | A1* | 3/2008 | Chung et al. | 345/98 |
| 2009/0284679 | A1* | 11/2009 | Kim et al. | 349/54 |
| 2010/0238149 | A1* | 9/2010 | Kishi et al. | 345/206 |
| 2013/0187167 | A1* | 7/2013 | JIN et al. | 257/72 |
| 2014/0240304 | A1* | 8/2014 | In et al. | 345/212 |
| 2014/0292827 | A1* | 10/2014 | Kang et al. | 345/690 |
| 2014/0346475 | A1* | 11/2014 | Cho et al. | 257/40 |

FOREIGN PATENT DOCUMENTS

| | | |
|---|---|---|
| JP | 2007-316511 | 12/2007 |
| KR | 10-2008-0077778 | 8/2008 |
| KR | 10-2008-0100533 | 11/2008 |
| KR | 10-2009-0109928 | 10/2009 |

* cited by examiner

*Primary Examiner* — Tom Sheng
(74) *Attorney, Agent, or Firm* — Knobbe, Martens, Olson & Bear, LLP

(57) ABSTRACT

A display device and a driving method thereof are disclosed. In one aspect, the display device includes a plurality of pixels, each including a driver which generates a driving current according to an input image data signal and a light emission portion formed of an organic light-emitting diode which emits light according to the driving current and at least one dummy pixel connected to a repair line that is connected to a light emission portion of at least one first pixel among the plurality of pixels. The dummy pixel includes a dummy pixel driver having the same structure as the drivers of each of the plurality of pixels, a dummy pixel light emission portion formed of an organic light-emitting diode, and a repair driver which transmits a driving current generated in the dummy pixel driver through the repair line when a driver of the first pixel fails.

25 Claims, 8 Drawing Sheets

PIXEL, DISPLAY DEVICE COMPRISING THE SAME AND DRIVING METHOD THEREOF

CROSS-REFERENCE TO RELATED APPLICATIONS

This application claims priority to and the benefit of Korean Patent Application No. 10-2013-0059847 filed in the Korean Intellectual Property Office on May 27, 2013, the entire contents of which are incorporated herein by reference.

BACKGROUND

1. Field

The described technology generally relates to a pixel, a display device including the pixel, and a method for driving the display device.

2. Description of the Related Technology

Organic light-emitting diode (OLED) displays generally display images by using self-emissive OLEDs. The luminance of OLEDs is controlled by a current or voltage supplied thereto.

In general, OLED displays are classified as either passive matrix type OLEDs (PMOLED) or active matrix type OLEDs (AMOLED) according to driving mechanism.

AMOLEDs select every unit pixel when displaying light and typically have high resolution, contrast, and operation speeds.

In AMOLED displays, each pixel typically includes a driving transistor which controls the current supplied to the OLED, and the OLED emits light corresponding to the driving current in accordance with a data signal input through the driving transistor.

However, such pixel circuits may be complex and thus manufacturing these circuits is complicated. Thus, the manufacturing yield may be decreased as the size and resolution of the display device is increased.

Therefore, if a defective pixel is made during the typical manufacturing process, a repair process should be performed in order to utilize the pixel.

The above information disclosed in this Background section is only intended to facilitate understanding of the background of the described technology and therefore it may contain information that does not constitute the prior art that is already known in this country to a person of ordinary skill in the art.

SUMMARY OF CERTAIN INVENTIVE ASPECTS

One inventive aspect is to increase the manufacturing yield of an OLED display by repairing defective pixels so that they may operate as normal pixels through a repairing process and thus improve the screen quality or product quality deterioration of the OLED display.

Another aspect is a pixel structure that enables the repair of a defective pixel, an OLED display device that can control a repair process according to a driving method of the OLED display device, and a method for driving the same.

Another aspect is a display device comprising: a plurality of pixels, each including a driver generating a driving current according to an input image data signal and a light emission portion formed of an organic light-emitting diode emitting light according to the driving current; and at least one dummy pixel electrically connected to a repair line that is electrically connected to a light emission portion of at least one first pixel among the plurality of pixels. The dummy pixel includes: a dummy pixel driver having the same structure as the driver of each of the plurality of pixels, a dummy pixel light emission portion formed of an organic light-emitting diode, and a repair driver transmitting a driving current generated by the dummy pixel driver through the repair line when the driver of the first pixel has failed.

The repair driver may include: a first repair transistor turned on during a light emission period of the plurality of pixels to electrically connect the dummy pixel driver to the repair line; a second repair transistor provided between the dummy pixel driver and the dummy pixel light emission portion and being turned on during a non-light emission period of the plurality of pixels and being turned off during the light emission period of the plurality of pixels; and a third repair transistor turned on during a predetermined period before the light emission period of the plurality of pixels to apply an initialization driving voltage to the repair line.

The first repair transistor may include a gate electrode electrically connected to a first repair control line transmitting a first repair control signal, a first electrode electrically connected to the dummy pixel driver, and a second electrode electrically connected to the repair line.

The driver of each of the plurality of pixels and the dummy pixel driver may each respectively include: a driving transistor, including a gate electrode electrically connected to a first node, a first electrode electrically connected to a first power source voltage, and a second electrode electrically connected to a third node; a switching transistor, including a gate electrode electrically connected to the corresponding scan line which receives a scan signal, a first electrode electrically connected to the corresponding data line, and a second electrode electrically connected to a second node; a compensation transistor, including a gate electrode electrically connected to a first control line which receives a first control signal, a first electrode electrically connected to the first node, and a second electrode electrically connected to the third node; a storage capacitor, including a first electrode electrically connected to the first power source voltage and a second electrode electrically connected to the second node; and a compensation capacitor, including a first electrode electrically connected to the first node and a second electrode electrically connected to the second node.

The driver of each of the plurality of pixels and the dummy pixel driver are controlled by a voltage level of the first power source voltage and a voltage level of a second power source voltage electrically connected with an organic light-emitting diode of each of the plurality of pixels and a cathode of an organic light-emitting diode in the dummy pixel.

While the first power source voltage is applied as a predetermined high level voltage and the second power source voltage is applied as a predetermined low level voltage, the organic light-emitting diodes of the respective pixels substantially simultaneously emit light and the organic light-emitting diode of the dummy pixel does not emit light.

Another aspect is the driver of each of the plurality of pixels and the dummy pixel driver may each respectively include: a switching transistor, including a gate electrode electrically connected to the corresponding scan line which receives a scan signal, a first electrode electrically connected to the corresponding data line, and a second electrode electrically connected to a fourth node; a compensation transistor, including a gate electrode electrically connected to a first control line which receives a first control signal, a first electrode electrically connected to the first node, and a second electrode electrically connected to the third node; a relay transistor, including a gate electrode electrically connected to a second control line which receives a second control signal, a first electrode electrically connected to the fourth node, and a second electrode electrically connected to a second node; a sustain transistor, including a gate electrode electrically connected to the first control line, a first electrode electrically connected to the corresponding data line, and a second electrode electrically connected to the second node; a storage capacitor, including a first electrode electrically connected to the first power source voltage and a second electrode electrically connected to the second node; a compensation capacitor, including a first electrode electrically connected to the first node and a second electrode electrically connected to the second node; and a sustain capacitor, including a first electrode electrically connected to the fourth node and a second electrode electrically connected to a power supply transmitting a predetermined reference voltage.

The driver of each of the plurality of pixels and the driver of the dummy pixel driver are controlled by a voltage level of the first power source voltage and a voltage level of a second power source voltage electrically connected with an organic light-emitting diode of each of the plurality of pixels and a cathode of an organic light-emitting diode of the dummy pixel.

While the first power source voltage is applied as a predetermined high level voltage and the second power source voltage is applied as a predetermined low level voltage, the organic light-emitting diodes of the respective pixels substantially simultaneously emit light and the organic light-emitting diode of the dummy pixel does not emit light.

In addition, while the first power source voltage is applied as a predetermined high level voltage and the second power source voltage is applied as a predetermined low level voltage, scan signals corresponding to the gate electrodes of the switching transistors of the respective drivers of the plurality of pixels and the dummy pixel driver are sequentially applied with a gate on voltage level.

Another aspect is the drivers of the plurality of pixels and the dummy pixel driver may each respectively include: a driving transistor, including a gate electrode electrically connected to a first node, a first electrode electrically connected to a first power source voltage, and a second electrode electrically connected to a third node; a switching transistor, including a gate electrode electrically connected to the corresponding scan line which receives a scan signal, a first electrode electrically connected to a power supply applying a predetermined reference voltage, and a second electrode electrically connected to a fourth node; a compensation transistor, including a gate electrode electrically connected to a first control line which receives a first control signal, a first electrode electrically connected to the first node, and a second electrode electrically connected to the third node; a relay transistor, including a gate electrode electrically connected to a second control line which receives a second control signal, a first electrode electrically connected to the fourth node, and a second electrode electrically connected to a second node; a sustain transistor, including a gate electrode electrically connected to a third control line which receives a third control signal, a first electrode electrically connected to the first power source voltage, and a second electrode electrically connected to the second node; a storage capacitor, including a first electrode electrically connected to the first node and a second electrode electrically connected to the second node; and a sustain capacitor, including a first electrode electrically connected to the corresponding data line and a second electrode electrically connected to the fourth node.

In this case, the driver of each of the plurality of pixels and the dummy pixel driver are controlled by a voltage level of the first power source voltage and a voltage level of a second power source voltage electrically connected with an organic light-emitting diode of each of the plurality of pixels and a cathode of an organic light-emitting diode of the dummy pixel.

Another aspect is a display device comprising: a display unit including the plurality of pixels and the at least one dummy pixel; a scan driver transmitting a plurality of scan signals corresponding to the plurality of pixels and the at least one dummy pixels; a data driver transmitting a plurality of image data signals corresponding to the plurality of pixels and the at least one dummy pixel; a power supply supplying a plurality of power source voltages and a predetermined reference voltage for driving of the plurality of pixels and the at least one dummy pixel; a compensation control signal unit transmitting a plurality of control signals that control operations of the drivers of the plurality of pixels and the dummy pixel driver; a repair control signal unit transmitting a plurality of repair control signals that control operation of the repair driver; and a signal controller generating and transmitting a plurality of driving control signals that control the scan driver, the data driver, the power supply, the compensation control signal unit, and the repair control signal unit, processing an external image signal, and transmitting the image data signal to the data driver.

Another aspect is a pixel comprising: a first driver including a driving transistor generating a driving current according to an image data signal, a switching transistor activating an external pixel corresponding to a scan signal, a compensation transistor compensating for a threshold voltage of the driving transistor, a storage capacitor storing a voltage corresponding the image data signal, and a compensation capacitor storing the threshold voltage of the driving transistor during a predetermined period; a first light emission portion including an organic light-emitting diode; and a repair driver provided between a first electrode of the driving transistor and a repair line electrically connected to an organic light-emitting diode of an external pixel, and including a first repair transistor transmitting a driving current to the organic light-emitting diode of the external pixel, a second repair transistor formed between the first driver and the first light emission portion, and a third repair transistor electrically connected to the first driver by diode-connecting a gate electrode and a first electrode of the third repair transistor and applying an initialization driving voltage to the repair line.

Another aspect is a pixel comprising: a second driver including a driving transistor generating a driving current according to an image data signal, a switching transistor activating an external pixel corresponding to a scan signal, a compensation transistor compensating for a threshold voltage of the driving transistor, a relay transistor transmitting a voltage corresponding to a data voltage of the previous frame, a sustain transistor transmitting a predetermined voltage applied through the corresponding data line in substantial synchronization with a switching operation of the compensation transistor, a sustain capacitor storing a voltage corresponding to a data voltage of the present frame corresponding to the switching operation of the switching transistor, a storage capacitor storing a voltage corresponding to a data voltage of the previous frame received from the relay transistor, and a compensation capacitor storing the threshold voltage of the driving transistor; a second light emitting portion including an organic light-emitting diode; and a repair driver provided between a first electrode of the driving transistor and a repair line electrically connected to an organic light-emitting diode of an external pixel, and including a first repair transistor transmitting a driving current to the organic light-emitting diode of the external pixel, a second repair transistor formed between the second driver and the second light emission portion, and a third repair transistor electrically connected to the second driver by diode-connecting a gate electrode and a first electrode of the third repair transistor and applying an initialization driving voltage to the repair line.

Another aspect is a pixel comprising: a third driver including a driving transistor generating a driving current according to an image data signal, a switching transistor activating an external pixel corresponding to a scan signal, a compensation transistor compensating for a threshold voltage of the driving transistor, a relay transistor transmitting a voltage corresponding to a data voltage of the previous frame, a sustain transistor transmitting a first power source voltage to a gate electrode terminal of the driving transistor, a sustain capacitor receiving and storing a voltage corresponding to a data voltage of the previous frame through the corresponding data line, and storage capacitor storing a voltage corresponding to a data voltage of the previous frame transmitted through the relay transistor; a third light emission portion including an organic light-emitting diode; and a repair driver provided between a first electrode of the driving transistor and an organic light-emitting diode of an external pixel, and including a first repair transistor transmitting a driving current to the organic light-emitting diode of the external pixel, a second repair transistor formed between the third driver and the third light emission portion, and a third repair transistor electrically connected to the third driver by diode-connecting a gate electrode and a first electrode of the third repair transistor and applying an initialization driving voltage to the repair line.

Another aspect is a method for driving a display device including a plurality of pixels and at least one dummy pixel. Each of the plurality of pixels includes an organic light-emitting diode, a driving transistor generating a driving current according to an image data signal, a switching transistor responding to a scan signal, a compensation transistor compensating for a threshold voltage of the driver transistor, a storage capacitor storing a voltage corresponding to the image data signal, and a compensation capacitor storing the threshold voltage of the driving transistor, and the at least one dummy pixel has the same structure as the plurality of pixels and includes a repair driver electrically connected with a repair line that is electrically connected to an organic light-emitting diode of a pixel among the plurality of pixels.

The method for driving the display device includes: applying a first voltage to a gate electrode of the driving transistor through the corresponding data line; resetting a voltage of a drain electrode of the driving transistor to a low-level first power source voltage; compensating for the threshold voltage of the driving transistor by turning on the compensation transistor; transmitting a voltage according to the image data signal through the corresponding data line in response to the corresponding scan signals sequentially transmitted through the switching transistors of each of the plurality of pixels and the dummy pixel and storing the voltage in the storage capacitor; and applying a low-level second power source voltage to a cathode of the organic light-emitting diode such that organic light-emitting diodes of the plurality of pixels substantially simultaneously emit light in accordance with the driving current.

The repair driver of the dummy pixel includes a first repair transistor transmitting a driving current generated from the driving transistor of the dummy pixel to the repair line, and the first repair transistor is turned on when the organic light-emitting diodes of the plurality of pixels substantially simultaneously emit light.

The repair driver of the dummy pixel further includes a second repair transistor provided between the driving transistor of the dummy pixel and an organic light-emitting diode of the dummy pixel, the second repair transistor is turned on in the applying of the first voltage, the resetting, the compensating, and the scanning, and the second repair transistor is turned off in the substantially simultaneous light emission of the organic light-emitting diodes.

The repair driver of the dummy pixel further includes a third repair transistor of which a first electrode of the third repair transistor is electrically connected to a node of the driving transistor of the dummy pixel and the repair line, and a gate electrode and a second electrode of the third repair transistor are electrically connected to each other, and the third repair transistor is turned on during a predetermined period before the substantially simultaneous light emission to apply an initialization driving voltage to the repair line.

Another aspect is a method for driving a display device including a plurality of pixels and at least one dummy pixel. Each of the plurality of pixels includes an organic light-emitting diode, a driving transistor generating a driving current according to an image data signal, a switching transistor responding to a scan signal, a compensation transistor compensating for a threshold voltage of the driving transistor, a relay transistor transmitting a data voltage of the previous frame to a gate electrode terminal of the driving transistor, a sustain capacitor programming and storing a data voltage of the present frame received from the corresponding data line, and a storage capacitor storing a voltage corresponding to the data voltage of the previous frame, and the dummy pixel has the same structure as the plurality of pixels and includes a repair driver electrically connected to a repair line that is electrically connected to an organic light-emitting diode of at least one pixel of the plurality of pixels.

The method for driving the display device includes: resetting a voltage of a drain electrode of the driving transistor to a low-level first power source voltage; compensating for the threshold voltage of the driving transistor by turning on the compensation transistor; transmitting a data voltage of the previous frame stored in the sustain capacitor to the gate electrode terminal of the driving transistor by turning on the relay transistor; substantially simultaneously emitting light from the organic light-emitting diodes of the plurality of pixels with in accordance with the driving current according to the data voltage of the previous frame by applying a low-level second power source voltage to a cathode of the organic light-emitting diode; and turning on the switching transistors for each of the plurality of pixels and the dummy pixel according to sequentially transmitted scan signals substantially at the same time as the substantially simultaneous light emission, and storing the data voltage of the present frame applied through the corresponding data line.

The repair driver of the dummy pixel includes a first repair transistor transmitting a driving current generated from the driving transistor of the dummy pixel to the repair line, and the first repair transistor is turned on in the substantially simultaneous light emission.

The period of the substantially simultaneous light emission may be longer than or equal to the period of the scanning, and the substantially simultaneous light emission and the scanning may be substantially at the same time in each of the plurality of pixels and the dummy pixel.

The repair driver of the dummy pixel further includes a second repair transistor provided between the driving transistor of the dummy pixel and an organic light-emitting diode of the dummy pixel, the second repair transistor is turned on in the resetting, the compensating, and the transmitting, and the second repair transistor is turned off in the substantially simultaneous light emission and the scanning.

The repair driver of the dummy pixel further includes a third repair transistor of which a first electrode of the third repair transistor is electrically connected to a node of the driving transistor of the dummy pixel and the repair line and a gate electrode and a second electrode of the third repair transistor are electrically connected to each other, and the third repair transistor is turned on during a predetermined period before the substantially simultaneous light emission to apply an initialization driving voltage to the repair line.

According to at least one embodiment, a pixel structure that can repair a defective pixel and a display device including the pixel structure are provided to thereby perform a repair process appropriate for a driving method in the display device and improve a manufacturing yield of the display device by recovering the functionality of the defective pixel to that of a normal pixel.

In addition, according to at least one embodiment, a luminance deviation due to the difference in operation between a repair pixel that recovers the functionality of a defective pixel according to a driving method of the display device and a normal pixel can be improved, thereby improving the productivity of the display device in order to have an excellent screen display quality.

DETAILED DESCRIPTION OF CERTAIN INVENTIVE EMBODIMENTS

Figure 1:
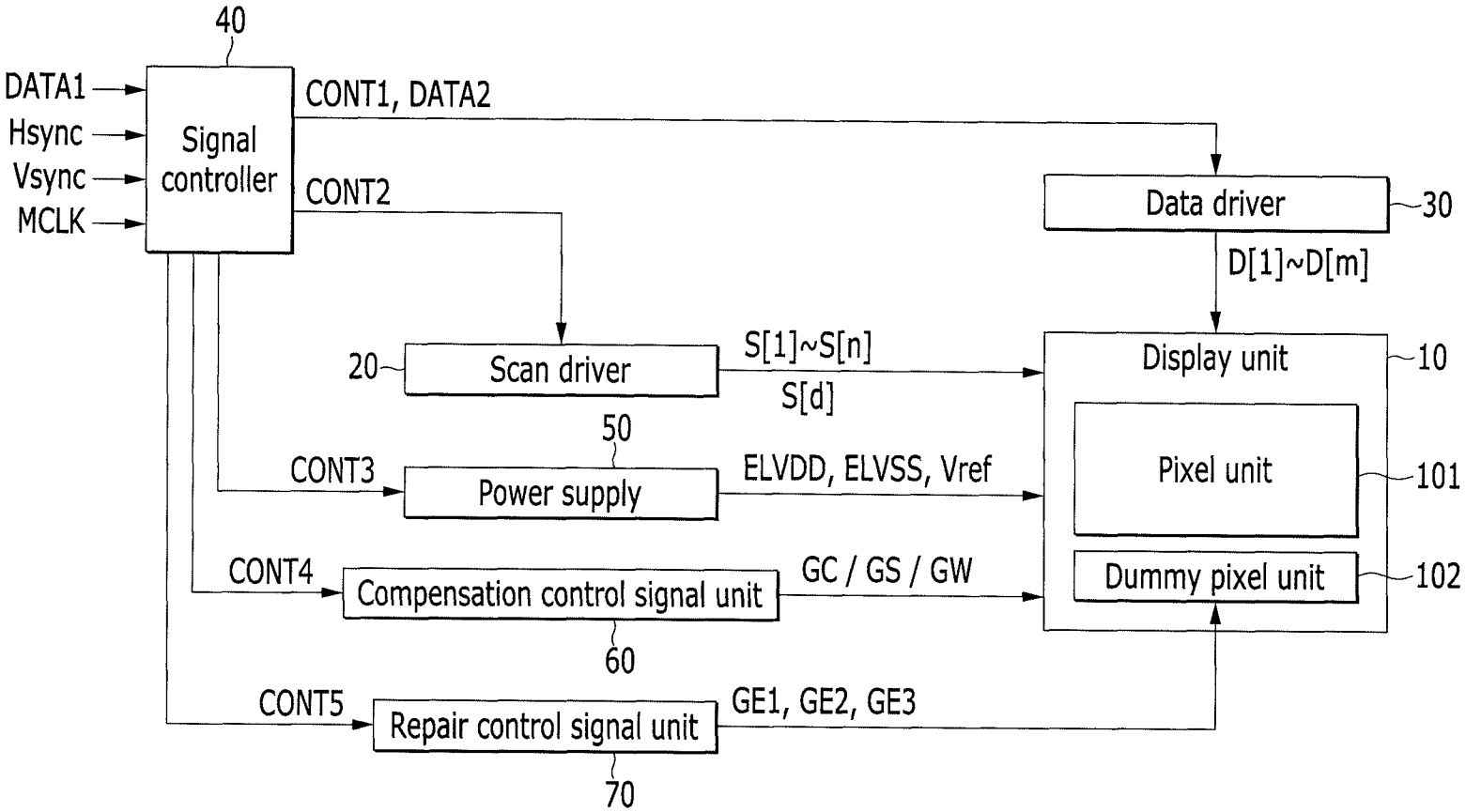
FIG. 1 is a block diagram of a display device according to an exemplary embodiment.

The described technology will be described more fully hereinafter with reference to the accompanying drawings, in which exemplary embodiments of the described technology are shown. As those skilled in the art would realize, the described embodiments may be modified in various different ways, all without departing from the spirit or scope of the described technology.

Further, in exemplary embodiments, since like reference numerals are used to designate like elements having the same configuration, a first exemplary embodiment is representatively described, and in other exemplary embodiments, only those configurations different from the first exemplary embodiment will be described.

Accordingly, the drawings and the description are to be regarded as illustrative in nature and not restrictive. Like reference numerals designate like elements throughout the specification.

Throughout the specification and the accompanying claims, when it is described that an element is "coupled" to another element, the element may be "directly coupled" to the other element or "coupled" to the other element through a third element. Throughout the specification, "connected" and "coupled" respectively include "electrically connected" and "electrically coupled." In addition, unless explicitly described to the contrary, the word "comprise" and variations such as "comprises" or "comprising" will be understood to imply the inclusion of the stated elements but not the exclusion of any other elements.

FIG. 1 is a block diagram of a display device according to an exemplary embodiment.

Referring to FIG. 1, a display device includes a display unit 10, a scan driver 20, a data driver 30, a signal controller 40, a power supply 50, a compensation control signal unit 60, and a repair control signal unit 70.

The display device may include at least one of each of the compensation control signal unit 60 and the repair control signal unit 70 according to the configuration of a plurality of pixels included in the display unit 10 and the driving method thereof.

The display unit 10 is a display area including a plurality of pixels arranged substantially in a matrix format.

In further detail, the display unit 10 according to the present exemplary embodiment includes a pixel unit 101 which is a display area which may display an image and a dummy pixel unit 102 which is a dummy area that recovers and compensates for defective pixels of the pixel unit 101.

That is, the pixel unit 101 of the display unit 10 is formed of a plurality of pixels which display an image corresponding to a data signal according to an external image signal. In addition, the dummy pixel unit 102 of the display unit 10 is formed of a plurality of dummy pixels that assist a defective pixel in the plurality of pixels included in the pixel unit 101 to be driven as a normal pixel by repairing the defective pixel.

In the pixel unit 101 of the display unit 10, a plurality of scan lines extended substantially in a row direction, substantially parallel with each other, a plurality of data lies extended substantially in a column direction, substantially parallel with each other, and a plurality of power supply lines which supply a plurality of power voltages are respectively connected to the plurality of pixels.

In addition, according to an exemplary embodiment, the dummy pixel unit 102 may be extended in a row direction or a column direction on one side of the pixel unit 101. In the exemplary embodiment of FIG. 1, the dummy pixel unit 102 may include a dummy pixel additionally formed on one side of each pixel column of the plurality of pixels.

However, the described technology is not restricted to the exemplary embodiment described above. The dummy pixel unit may be iteratively extended in a row direction or a column direction for every several tens or several hundreds of pixel lines in the pixel unit.

In addition, although not shown in FIG. 1, each of the plurality of dummy pixels included in the dummy pixel unit 102 may be connected to a repair line that is extended to an anode of each of the plurality of pixels in the pixel unit 101 to repair a defective pixel among the plurality pixels included in the pixel unit 101. The alignment of the dummy pixels and the repair line and a method for repairing a defective pixel will be described in further detail with reference to FIG. 2.

Further, each of the plurality of pixels included in the pixel unit 101 of and each of the dummy pixels included in the dummy pixel unit 102 of the display unit 10 are connected to a plurality of first to third control lines GCL, GWL, and GSL (not shown) according to the configuration and the driving method thereof.

In addition, each of the dummy pixels of the dummy pixel unit 102 is connected to a plurality of first to third relay control lines GE1_L, GE2_L, and GE3_L (not shown).

The scan driver 20 is connected to a plurality of scan lines connected to each line of the plurality of pixels and the dummy pixels of the display unit 10, and generates and transmits a plurality of scan signals S[1] to S[n] respectively corresponding to the plurality of scan lines according to a scan driving control signal CONT2.

Among the plurality of scan signals, scan signals S[1]-S[n] are transmitted to the respective pixel lines of the plurality of pixels in the pixel unit 101, and a scan signal S[d] is transmitted to the plurality of dummy pixels of the dummy pixel unit 102. Although the scan signal S[d] transmitted to the dummy pixel unit 102 is described as being sequentially transmitted after the sequential transmission of the plurality of scan signals S[1] to S[n] to the pixel unit 101 in FIG. 1, it is not restricted thereto. A scan signal for a dummy pixel may be connected to a scan line connected to the dummy pixel unit depending on the configuration and alignment of the dummy pixel unit 102.

The scan driver 20 sequentially applies the scan signals S[1] to S[n] and S[d] having a pulse voltage with a gate-on level of a transistor formed in a pixel to the plurality of scan lines.

The data driver 30 is connected to a plurality of data lines connected to each of the plurality of pixels and each of the dummy pixels of the display unit 10 for each column, and samples and holds an externally input image signal DATA1 according to a data driving control signal CONT1, and transmits data voltages D[1] to D[m] that depends on a plurality of image-processed image data signals DATA2 respectively the plurality of data lines.

The data driver 30 applies data voltages D[1] to D[m] having a predetermined range to the plurality of data lines corresponding to the scan signals S[1] to S[n] having the gate-on pulse voltage.

The signal controller 40 receives the externally input image signal DATA1 and a synchronization signal. The image signal DATA1 includes luminance information for the plurality of pixels. Luminance may be classified into a predetermined number of gray levels, for example, 1024 ($=2^{10}$), 256 ($2^8$), or 64 ($=2^6$) gray levels. The synchronization signal includes a horizontal synchronization signal Hsync, a vertical synchronization signal Vsync, and a main clock signal MCLK.

The signal controller 40 generates a plurality of driving control signals CONT1 to CONT5 and the image data signal DATA2 according to the horizontal synchronization signal Hsync, the vertical synchronization signal Vsync, and the main clock signal MCLK.

The signal controller 40 divides the image signal DATA1 per frame unit according to the vertical synchronization signal Vsync and divides the image signal DATA1 per scan line unit to generate the image data signal DATA2.

The signal controller 40 transmits the image data signal DATA2 and the data driving control signal CONT1 to the data driver 30.

In addition, the signal controller 40 transmits the scan driving control signal CONT2 to the scan driver 20 so that the scan driver 20 may sequentially transmit the plurality of scan signals S[1] to S[n] having the gate-on pulse voltage.

In addition, the signal controller 40 may generate a power supply control signal CONT3 transmitted to the power supply 50, a compensation driving control signal CONT4 transmitted to the compensation control signal unit 60, and a repair driving control signal CONT5 transmitted to the repair control signal unit 70.

According to the driving method of the display device and the configuration of the pixels, the power supply control signal CONT3, the compensation driving control signal CONT4, and the repair driving control signal CONT5 may be formed as a plurality of driving control signals respectively having different control functions.

In further detail, the power supply control signal CONT3 may include a plurality of different power supply control signals that control a voltage level and timing for each of a first power source voltage ELVDD, a second power source voltage ELVSS, and a reference voltage Vref that are supplied from the power supply 50.

In addition, the compensation driving control signal CONT4 may include a plurality of different compensation driving control signals that control a pulse voltage level and timing for each of a first control signal GC, a second control signal GW, and a third control signal GS that are supplied from the compensation control signal unit 60.

In addition, the repair driving control signal CONT5 may include a plurality of different repair driving control signals that control a pulse voltage level and timing for each of a first repair control signal GE1, a second repair control signal GE2, and a third repair control signal GE3 that are generated from the repair control signal unit 70.

Meanwhile, the power supply 50 determines the level of each of the first power source voltage ELVDD, the second power source voltage ELVSS, and the reference voltage Vref according to the power supply control signal CONT3 and then supplies the determined voltages to the power supply lines connected to the plurality of pixels.

The first power source voltage ELVDD and the second power source voltage ELVSS supply a driving current to the pixels. According to the driving type of the display device, the power supply 50 controls the timing of the application of the second power voltage ELVDD as a low level voltage according to a predetermined value of the maximum luminance of the pixels to control the light emission period during which the plurality of pixels substantially simultaneously emit light. The power supply 50 controls the timing of the application of the first power source voltage ELVDD as a low level voltage to control the reset of and a threshold voltage compensation period of the plurality of pixels. In addition, the power supply 50 may supply the reference voltage Vref to an additional power supply line connected to the plurality of pixels.

The compensation control signal unit 60 determines a pulse voltage level of at least one of the first control signal GC, the second control signal GW, and the third control signal GS according to the compensation driving control signal CONT4 and applies the signals having the determined pulse voltage level to the corresponding control lines connected to the display unit.

In further detail, according to the implementation type, the compensation control signal unit 60 generates the first control signal GC and transmits the same to a first control line (not shown) according to the compensation driving control signal CONT4. In addition, according to the configuration of the pixels and the driving method of the display device, the compensation control signal unit 60 may additionally generate the second control signal GW and transmit the same to a second control line (not shown), or may generate the third control signal GS and transmit the same to a third control line (not shown).

Here, the first control signal GC may be a control signal for compensation of a threshold voltage of a driving transistor of the pixels, and the second control signal GW may be a control signal for relaying a data voltage that depends on the corresponding image data signal applied to the previous frame to a predetermined node in the pixels for light emission. Further, the third control signal GS may be a control signal for maintaining a predetermined node voltage in the pixels for a predetermined time period.

The repair control signal unit 70 determines the pulse voltage level of the first repair control signal GE1, the second repair control signal GE2 and the third repair control signal GE3 according to the repair driving control signal CONT5 and applies the signals having the determined pulse voltage levels to the corresponding repair control lines connected to the dummy pixel unit 102 of the display unit.

In further detail, the repair control signal unit 70 generates the first repair control signal GE1 according to the repair driving control signal CONT5 and transmits the same to a first repair control line GE1_L (not shown). In addition, the repair control signal unit 70 generates the second repair control signal GE2 and transmits the same to a second repair control line GE2_L (not shown), and generates the third repair control signal GE3 and transmits the same to a third repair control line GE3_L (not shown).

Figure 2:
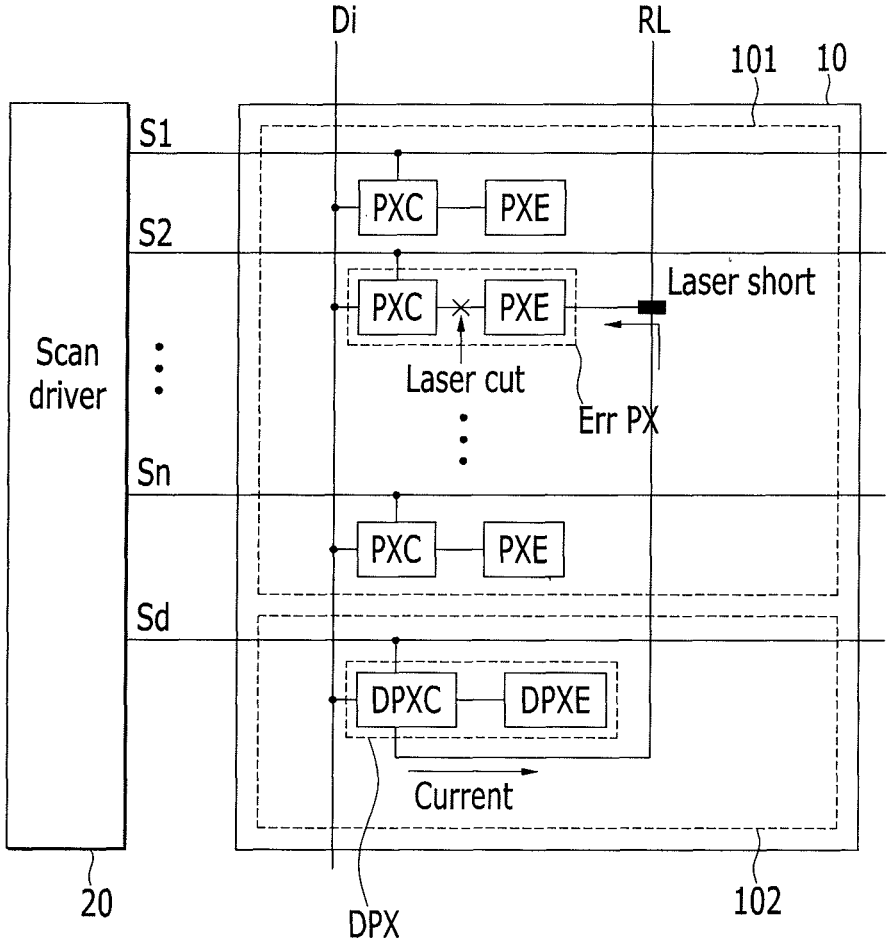
FIG. 2 shows a partial connection structure of a pixel in the display unit of FIG. 1 and a method for recovering the functionality of a defective pixel.

FIG. 2 schematically shows a part of the pixel connection structure of the display unit 10 of FIG. 1 and a method for repairing a deflective pixel according to an exemplary embodiment.

In further detail, FIG. 2 illustrates pixels and dummy pixels arranged in the i-th column of the plurality of pixels and the plurality of dummy pixels respectively included in the pixel unit 101 and the dummy pixel unit 102 of the display unit 10 in FIG. 1.

The pixels and a dummy pixel DPX arranged in the i-th column are connected with the corresponding scan lines S1 to Sn and Sd connected to the scan driver 20 for each line. In addition, a data line Di corresponding to the i-th column is connected to the pixels and the dummy pixel DPX.

The pixels and the dummy pixel DPX are respectively funned of driving circuits which generate driving currents according to data signals and transmit the driving currents to light emission portions which emit light with luminance corresponding to the driving current. That is, each of the plurality of pixels included in the pixel unit 101 of the display unit 10 is formed of a driving circuit PXC and a light emission portion PXE. In addition, according to the present exemplary embodiment, each of the plurality of dummy pixels DPX included in the dummy pixel unit 102 of the display unit 10 is also formed of a driving circuit DPXC and a light emission portion DPXE.

In FIG. 2, each of the plurality of pixels included in the pixel unit 101 is connected to a corresponding scan line that corresponds to the driving circuit PXC and the i-th data line such that operation of the pixel is controlled by the corresponding scan signal and the driving circuit PXC generates a driving current according to the transmitted data signal. In addition, the driving current generated from the driving circuit PXC of the pixel is transmitted to the light emission portion PXE and thus light is emitted with a corresponding luminance such that an image is displayed.

The dummy pixel of the dummy pixel unit 102 of FIG. 2 is also connected with the scan line Sd for the dummy pixel corresponding to the driving circuit DPXC and the i-th data line. In addition, according to the present exemplary embodiment, the dummy pixel includes a light emission portion DPXE connected to the driving circuit DPXC.

Light emitted from the light emission portion DPXE of the dummy pixel is controlled according to the first to third repair control signals transmitted from the repair control signal unit 70.

In the exemplary embodiment of FIG. 2, the dummy pixels DPX are arranged in the lowest end of the column of pixels, and the dummy pixel DPX and each of the plurality of pixels arranged in the upper portion of the column may be connected to each other through a repair line RL disposed along the column direction. In further detail, the repair line RL is extended to the driving circuit of the dummy pixel from the anodes of each of the plurality of pixels of the pixel unit 101. The driving circuit DPXC of the dummy pixel and the repair line RL may be connected and an anode of a light emission portion PXE of a pixel (i.e., a defective pixel) and the repair line RL may be connected by a laser short.

Thus, when a driving circuit of a pixel among the plurality of pixels is defective, the anode of a light emission portion of the pixel and the repair line are short-circuited by a laser, and a driving circuit DPXC of a dummy pixel formed in the corresponding column of the defective pixel and the repair line are short-circuited by a laser. Then, a driving current that depends on an image data signal corresponding to the defective pixel is transmitted to the light emission portion of the defective pixel from the driving circuit of the dummy pixel DPX through the repair line. Accordingly, the defective pixel is repaired to functions as a normal pixel and thus generates light with normal luminance.

In this case, the connection between the driving circuit PXC and the light emission portion PXE of the defective pixel should be cut by the laser.

In the exemplary embodiment of FIG. 2, when the second pixel of the i-th column is determined to be a defective pixel ErrPX and thus the driving circuit PXC thereof cannot be driven normally, the connection between a driving circuit PXC and a light emission portion PXE of the defective pixel ErrPX is cut by a laser and the light emission portion PXE of the defective pixel ErrPX and the repair line RL are connected using a laser short. Since the repair line RL is connected to the driving circuit DPXC of the dummy pixel DPX corresponding to the defective pixel ErrPX, a driving current is transmitted to the light emission portion PXE of the defective pixel ErrPX by the driving circuit DPXC of the dummy pixel DPX so that light may be emitted normally.

Figure 3:
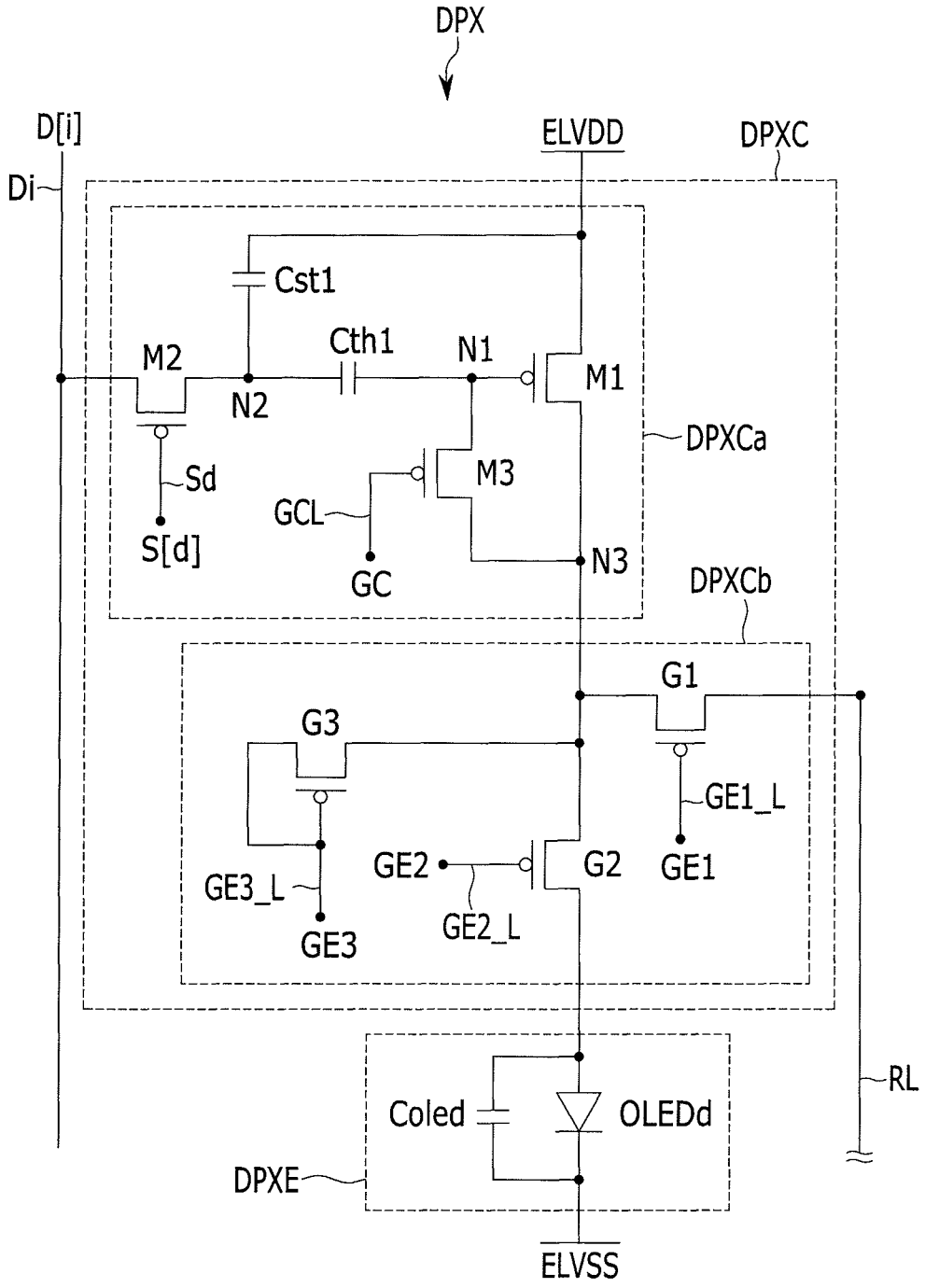
FIG. 3 is a circuit diagram of the structure of a dummy pixel of the display device according to an exemplary embodiment.

FIG. 3 is a circuit diagram of a dummy pixel structure of a display device according to an exemplary embodiment.

A dummy pixel DPX of the display device according to the exemplary embodiment of FIG. 3 is included in the dummy pixel unit 102 of FIG. 2, and is formed of the driving circuit DPXC of the dummy pixel and the light emission portion DPXE of the dummy pixel.

The driving circuit PDXC of the dummy pixel is connected with the repair line RL by a laser short when a defective pixel is detected in the pixel unit 101 of the display unit and thus the driving circuit PDXC is electrically connected with the light emission portion of the defective pixel.

In addition, the driving circuit DPXC of the dummy pixel may be formed of a first driving portion, that is, a light emission driver DPXCa, and a second driving portion, that is, a repair driver DPXCb.

The light emission driver DPXCa is a circuit that activates the corresponding dummy pixel DPX to generate and transmit a driving current for a data voltage for light emission.

In addition, the repair driver DPXCb is a compensation circuit that compensates for a failure in the defective pixel by being connected with the repair line RL using a laser short in the corresponding dummy pixel DPX when a defective pixel is generated in the pixel unit 101.

In the display device according to the present exemplary embodiment, the structure of each of the plurality of pixels included in the pixel unit 101 is not illustrated, however, each of the plurality of pixels may have the same structure as that of the dummy pixel PDX, excluding the repair driver DPXCb of the dummy pixel DPX. That is, each of the plurality of pixels that form the pixel unit to display an image according to an image signal has a structure in which the light emission driver DPXCa and the light emission portion DPXE of the dummy pixel DPX are connected.

In further detail, referring to FIG. 3, the light emission driver DPXCa of the dummy pixel includes a driving transistor M1, a switching transistor M2, a compensation transistor M3, a storage capacitor Cst1, and a compensation capacitor Cth1. The light emission driver DPXCa of FIG. 3 is commonly used for the pixels included in the pixel unit, and therefore the connections and functions of the circuits included in each of the light emission drivers of the pixels are the same as the circuit included in the light emission drivers of the dummy pixel.

The driving transistor M1 includes a gate electrode connected to a first node N1, a first electrode connected to the first power source voltage ELVDD, and a second electrode connected to a third node N3.

The driving transistor M1 generates a driving current corresponding to a data voltage that depends on an image data signal transmitted to the first node N1 and transmits the driving current to the organic light-emitting diode of the light emission portion.

The switching transistor M2 includes a gate electrode connected to the corresponding scan line Sd among the plurality of scan lines, a first electrode connected to the corresponding data line Di among the plurality of data lines, and a second electrode connected to the second node N2.

The switching transistor M2 is turned on by a scan signal S[d] having a pulse voltage of a gate-on level transmitted through the scan line Sd and transmits a data voltage D[i] that depends on the image data signal transmitted through the data line Di to the second node N2.

The compensation transistor M3 includes a gate electrode connected to the first control line GCL, a first electrode connected to the first node N1, and a second electrode connected to the third node N3.

The compensation transistor M3 is turned on by the first control signal GC having a pulse voltage of a gate-on level transmitted through the first control line GCL and diode-connects the gate electrode and the second electrode of the driving transistor M1. Thus, in the equation for calculating the amount of driving current that depends on the data voltage applied to a gate electrode terminal of the driving transistor M1, the threshold voltage of the driving transistor is removed to eliminate and compensate for a threshold voltage deviation of the driving transistors of the pixels included in the display unit.

The storage capacitor Cst1 includes a first electrode connected to the first power source voltage ELVDD and a second electrode connected to the second node N2. Since the storage capacitor Cst1 stores a voltage value corresponding to a voltage difference between lateral ends of the storage capacitor Cst1, the storage capacitor Cst1 maintains and stores the data voltage applied to the second node N2.

The compensation capacitor Cth1 includes a first electrode connected to the first node N1 and a second electrode connected to the second node N2. The compensation capacitor Cth1 maintains a voltage difference between lateral ends thereof, and therefore the compensation capacitor Cth1 maintains a voltage value corresponding to the threshold voltage of the driving transistor applied to the first node N1 during a compensation period of the driving transistor.

Meanwhile, the light emission portion DPXE of the dummy pixel includes an organic light-emitting diode OLEDd connected to the repair driver DPXCb. Similarly, each of the plurality of pixels included in the pixel unit 101 includes an organic light-emitting diode OLED.

The organic light-emitting diode OLEDd includes an anode connected to the repair driver DPXCb and a cathode connected to the second power source voltage ELVSS.

The organic light-emitting diode includes an organic emission layer which emits light corresponding to a primary color. An example of a primary color may include red, green, or blue, and a desired color may be displayed as a spatial or temporal sum of primary colors.

The organic light-emitting diode OLED emits light with luminance that corresponds to the driving current which depends on the data signal transmitted from the driving transistor M1 to thereby display an image.

Further, the display device according to the exemplary embodiment includes a dummy pixel that further includes a repair driver DPXCb, and the repair driver DPXCb includes a first repair transistor G1, a second repair transistor G2, and a third repair transistor G3.

In the display device, the repair driver DPXCb is not included in each of the plurality of pixels of the pixel unit 101.

The first repair transistor G1 includes a gate electrode connected to the first repair control line GE1_L, a first electrode connected to the third node N3, and a second electrode connected to the repair line RL. The first repair transistor G1 is turned on in responding to a pulse voltage of a gate-on level of the first repair control signal GE1 transmitted through the first repair control line GE1_L. Then, the first repair transistor G1 transmits a driving current that depends on the data voltage transmitted from the driving transistor M1 through the repair line RL. The repair line RL is electrically connected to a pixel which has had a driving failure from among the plurality of pixels included in the pixel unit 101, and an electrical connection may be established by the laser short. Thus, the driving current that depends on the data voltage transmitted through the first repair transistor G1 of the dummy pixel DPX is transmitted to an organic light-emitting diode of the pixel having the driving failure through the repair line RL and the organic light-emitting diode emits light with a corresponding luminance.

Then, although a pixel has experienced a driving failure, the organic light-emitting diode of the defective pixel may emit light normally, thereby preventing luminance deterioration of the entire display unit.

The first repair transistor G1 maintains the turned-on state only during the light emission period of the display unit, and the driving current is transmitted to the repair line RL during this period so that the organic light-emitting diode of the defective pixel in the pixel unit can emit light. This will be described later in further detail in the description of driving timing.

The second repair transistor G2 includes a gate electrode connected to the second repair control line GE2_L, a first electrode connected to the third node N3, and a second electrode connected to the anode of the organic light-emitting diode OLEDd of the dummy pixel. The second repair transistor G2 is turned-on in response to a pulse voltage of a gate-on level of the second repair control signal GE2 transmitted through the second repair control line GE2_L. Then, the second repair transistor G2 substantially simultaneously performs initialization (or, reset) and compensation of a threshold voltage of the driving transistors for each of the plurality of pixels included in the pixel unit by using an organic light-emitting diode capacitor Coled included in the organic light-emitting diode OLEDd of the dummy pixel connected to the second electrode of the second repair transistor G2.

When a defective pixel has experienced a driving failure in the plurality of pixels included in the pixel unit, the driving current should be transmitted to the defective pixel using the repair line RL during the light emission period, and therefore the pulse voltage of the repair control signal GE2 is at a gate-off level and the second repair transistor G2 maintains a turned-off state.

The third repair transistor G3 includes a gate electrode connected to the third repair control line GE3_L, a first electrode connected to the third node N3, and a second electrode connected to the gate electrode terminal of the third repair transistor G3. That is, the third repair transistor G3 has a diode-connection structure so as to have the same characteristics as the organic light-emitting diode. The third repair transistor G3 is turned-on in response to a pulse voltage of a gate-on level of the third repair control signal GE3 transmitted through the third repair control line GE3_L. Then, a driving current which depends on the data voltage flowing in the driving transistor M1 connected to the third node N3 flows through the turned-on third repair transistor G3 with the same characteristics as a the organic light-emitting diode. Thus, the voltage of an organic light-emitting diode of the previous frame, applied to the repair line RL can be reset to a voltage of an organic light-emitting diode that is going to emit light.

That is, for such a reset, the third repair control signal GE3 is transmitted at a gate-on voltage level at the same time as the first repair transistor G1 is turned-on, that is, during a predetermined period at the initial stage of the light emission period.

The transistors forming the dummy pixel DPX of FIG. 3 may be PMOS transistors, but are not limited thereto. The transistors may alternatively be formed as an NMOS transistors.

Figure 4:
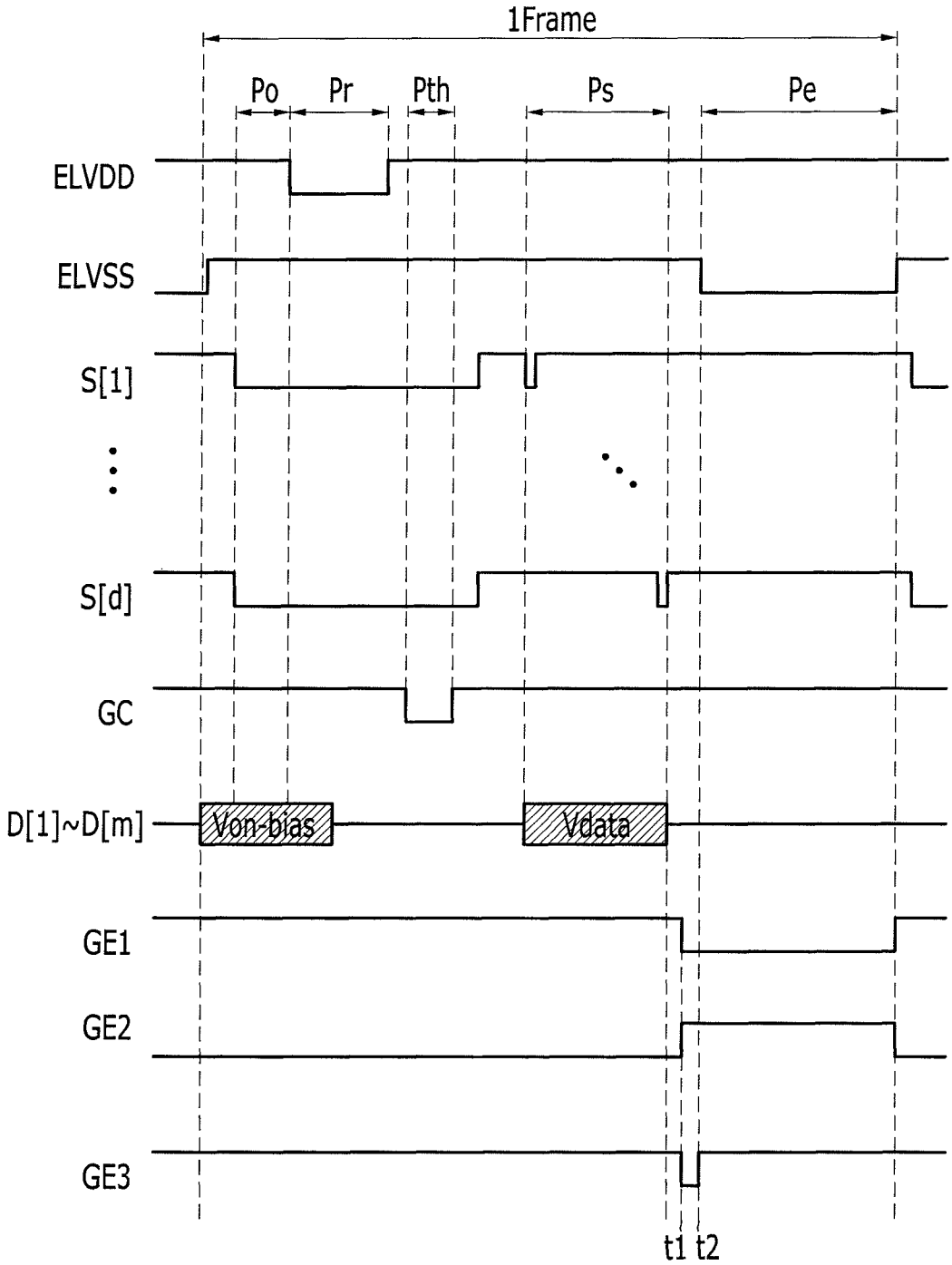
FIG. 4 is a timing diagram provided for describing a driving method of the display and a method for driving the dummy pixel according to the exemplary embodiment of FIG. 3.

A driving method and timing of the dummy pixel PDX and the plurality of pixels included in the pixel unit 101 are shown in FIG. 4. The timing diagram of FIG. 4 will be described in connection with the dummy pixel structure of FIG. 3, and therefore the voltage level that turns on the PMOS transistors of FIG. 3 is a low voltage level.

The circuit configuration of a general pixel is the same as that of the dummy pixel excluding the repair driver DPXCb of the dummy pixel, and therefore the operation for each pixel is the same as that of the dummy pixel.

In the timing diagram of FIG. 4, the dummy pixel 102 is provided in a lower end of the pixel unit 101 as in FIG. 1. Therefore, timing diagrams illustrated may apply to various exemplary embodiments.

Referring to FIG. 4, one frame period during which one image is displayed in the display unit 10 includes an on-bias period Po for improving a response waveform of a plurality of pixels, a reset period Pr for resetting the driving voltage of the organic light-emitting diode of each pixel, a compensation period Pth for compensating for a threshold voltage of the driving transistor of each pixel, a scan period Ps for transmitting a data voltage to each pixel, and a light emission period Pe for substantially simultaneous light emission of the plurality of pixels corresponding to the data voltage applied to the gate voltage of the driving transistors.

First, during the on-bias period Po, the first power source voltage ELVDD and the second power source voltage ELVSS are provided as high level voltages. In addition, the plurality of scan signals S[1] to S[d] transmitted to the plurality of pixels and the plurality of dummy pixels of the entire display unit are applied with low level voltages. Here, the scan signals S[1] to S[n] among the plurality of scan signals are scan signals respectively transmitted to each pixel line of the plurality of pixels that correspond to the pixel unit, and the scan signal S[d] is a scan signal transmitted to the plurality of dummy pixels that correspond to the dummy pixel unit provided in the lower end of the pixel unit. The scan signal S[d] is a scan signal transmitted to the dummy pixels formed of at least one line, like the dummy pixel unit of FIG. 1.

In addition, during the on-bias period Po, the first control signal GC is applied as a high level voltage, and the plurality of data signals D[1] to D[m] transmitted to the display unit are applied as a predetermined on-bias voltage Von-bias.

During this period, the first repair control signal GE1 and the third repair control signal GE3 are applied as high level voltages and the second repair control signal GE2 is applied as a low level voltage in the plurality of dummy pixels.

During the on-bias period Po, the plurality of pixels and the plurality of dummy pixels of the entire display unit are substantially simultaneously turned on according to the plurality of scan signals S[1] to S[d]. Then, a voltage according to the corresponding data signal among the plurality of data signals D[1] to D[m] is applied to a gate electrode terminal of the driving transistor M1, that is, the first node N1 in the circuit diagram of FIG. 3 through the data line. During this period, the plurality of data signals D[1] to D[m] are applied as the predetermined bias voltage Von-bias, and therefore, the gate electrodes of the driving transistors M1 of the entire pixels of the display unit are applied with the on-bias voltage Von-bias.

Since the gate electrodes of the driving transistors M1 of all the pixels are applied with a specific voltage (i.e., the on-bias voltage Von-bias) in advance, the response waveform of the pixels can be improved. According to the implementation type, the on-bias period Po may be omitted.

While the respective pixels of the display unit are in the turned-on state, the first power source voltage ELVDD is applied as a low level voltage during the reset period Pr. In the reset period Pr, the second power source voltage ELVSS is applied as a high level voltage. Thus, no current flows toward the organic light-emitting diode OLEDd from the driving transistor M1, but a voltage of the third node N3 passes through the turned-on driving transistor M1 and thus reaches the low-level voltage of the first power source voltage ELVDD. The third node N3 is a drain electrode terminal of the driving transistor M1, and the path of the driving current according to the image data signal is formed to the organic light-emitting diode through the third node N3. Therefore, the level of the driving current that depends on the image data signal transmitted in the previous frame is reset by the low level voltage of the first power source voltage ELVDD.

In the case of the plurality of dummy pixels, only the second repair transistor G2 is turned on at this time due to the second repair control signal GE2 applied as low level signal, and therefore, the drain electrode terminal (i.e., third node electrode) of the driving transistor of the dummy pixels is reset by the low-level first power source voltage ELVDD, just like the reset process for the plurality of pixels.

Next, during the compensation period Pth, the first power source voltage and the second power source voltage are applied as high level voltages while each of the plurality of pixels of the display unit is turned on by a scan signal. In this case, the first control signal GC is applied as a low-level gate-on voltage. The compensation transistor M3 is turned on with the first control signal GC. While the compensation transistor M3 is turned on, the driving transistor M1 is diode-connected and the threshold voltage of the driving transistor M1 is transmitted to the first node N1. Accordingly, the threshold voltage of the driving transistor M1 is stored in the compensation capacitor Cth1. The threshold voltage of the driving transistor M1 is thus removed from the calculation of the amount of driving current according to the input image data signal, and therefore the threshold voltage characteristic deviation of the driving transistor in each pixel can be eliminated. That is, the threshold voltage of the driving transistor of each pixel is compensated for during the compensation period Pth.

Thus, the display device can display an image with uniform luminance without regard to a deviation of the threshold voltage caused due to the characteristics of the driving transistor.

After the termination of the compensation period Pth, the plurality of scan signals S[1] to S[d] are increased to a high level. In addition, the first control signal GC is also increased to a high level.

During the scan period Ps, the plurality of scan signals S[1] to S[d] are sequentially transmitted to the plurality of pixels of the corresponding pixel lines with a low-level pulse voltage for each pixel line. The scan signal S[d] is also transmitted as the low-level pulse voltage to each of the plurality of dummy pixels at the lowest end of the dummy pixel line.

Then, the switching transistor M2 of FIG. 3 is turned on, and a data voltage Vdata that depends on the corresponding data signal among the plurality of data signals D[1] to D[m] is transmitted to the first electrode of the switching transistor M2.

The data voltage Vdata that depends on the data signal is transmitted to the second node N2 of each pixel and then stored in the storage capacitor Cst1.

During the on-bias period Po, the reset period Pr, the compensation period Pth, and the scan period Ps, the second power source voltage ELVSS is applied as a high level voltage, and therefore the organic light-emitting diode of each pixel and the organic light-emitting diode OLEDd of each dummy pixel do not emit light.

The first and third repair control signals GE1 and GE3 transmitted to the repair driver DPXCb of each dummy pixel is applied as a high level voltage during the on-bias period Po, the reset period Pr, the compensation period Pth, and the scan period Ps, and the second repair control signal GE2 is applied as a low level voltage during the on-bias period Po, the reset period Pr, the compensation period Pth, and the scan period Ps.

Thus, the first repair transistor G1 of the repair driver DPXCb of each dummy pixel maintains a turned-off state during a non-light emission period (the on-bias period Po, the reset period Pr, the compensation period Pth, and the scan period Ps) so that a parasitic capacitor generated due to a laser short connection during resetting of the dummy pixel circuit and the threshold voltage compensation of the driving transistor can be separated.

In addition, the third repair transistor G3 of the repair driver DPXCb also maintains a turned-off state during the non-light emission period.

In addition, during the non-light emission period, the second repair transistor G2 of the repair driver DPXCb maintains a turned-on state to perform initialization, reset, and threshold voltage compensation in the same way as that of a typical pixel by using the capacitor Coled of the organic light-emitting diode.

However, during the non-light emission period, the second power source voltage ELVSS is applied as a high level voltage to the cathode of the organic light-emitting diode OLEDd of the dummy pixel so that no current flow is generated toward the organic light-emitting diode.

Moreover, during the light emission period Pe, the first power source voltage ELVDD is applied as a high level voltage and the second power source voltage ELVSS is applied as a low level voltage.

Then, a current path is formed from the first power source voltage ELVDD to the organic light-emitting diode OLED, and the amount of driving current flowing through the current path corresponds to a data voltage that depends on the image data signal stored in the storage capacitor Cst1 during the light emission period Pe.

The organic light-emitting diode OLED of each pixel emits light with luminance that corresponds to the driving current.

The light emission period Pe is performed across the plurality of pixels of the display unit 10, and therefore the plurality of pixels substantially simultaneously emit light with a luminance corresponding to display an image.

During the light emission period Pe, the second and third repair control signals GE2 and GE3 transmitted to the repair driver DPXCb of each of the plurality of dummy pixels are applied as high level voltages and the first repair control signal GE1 is applied as a low level voltage.

Thus, during the light emission period Pe1, the second repair transistor G2 maintains a turned-off state so that a driving current can be prevented from flowing to the organic light-emitting diode OLEDd of the dummy pixel, thereby preventing the organic light-emitting diode OLEDd from emitting light.

In addition, the third repair transistor G3 of the repair driver DPXCb of each dummy pixel maintains a turned-off state during the light emission period Pe. However, the third repair control signal GE3 is transmitted as a low level voltage during a period from a time t1 to a time t2 before the start of the light emission period Pe. Thus, the third repair transistor G3 is turned on during the period from t1 to t2. That is, the third repair transistor G3 is turned on together with the first repair transistor G1 before the light emission period Pe, and the gate electrode is diode-connected. Thus, the driving voltage of an organic light-emitting diode of the previous frame stored in the repair line RL is initialized to the driving voltage of an organic light-emitting diode that is going to emit light. That is, when the third repair transistor G3 is turned on, a current flowing in the driving transistor M1 flows with the same characteristics of an organic light-emitting diode through the third repair transistor G3 so that the repair line RL may be initialized to the same voltage of the organic light-emitting diode of the light emission period.

Meanwhile, during the light emission period Pe, the first repair transistor G1 of the repair driver DPXCb of each dummy pixel is in the turned-on state and thus a driving current is transmitted to a light emission portion, that is, an organic light-emitting diode of a defective pixel having a driving failure among the plurality of pixels included in the pixel unit 101, through the repair line RL. Then, light can be emitted even through a pixel has experienced a driving failure, thereby preventing deterioration of luminance uniformity over than entire display unit.

Figure 5:
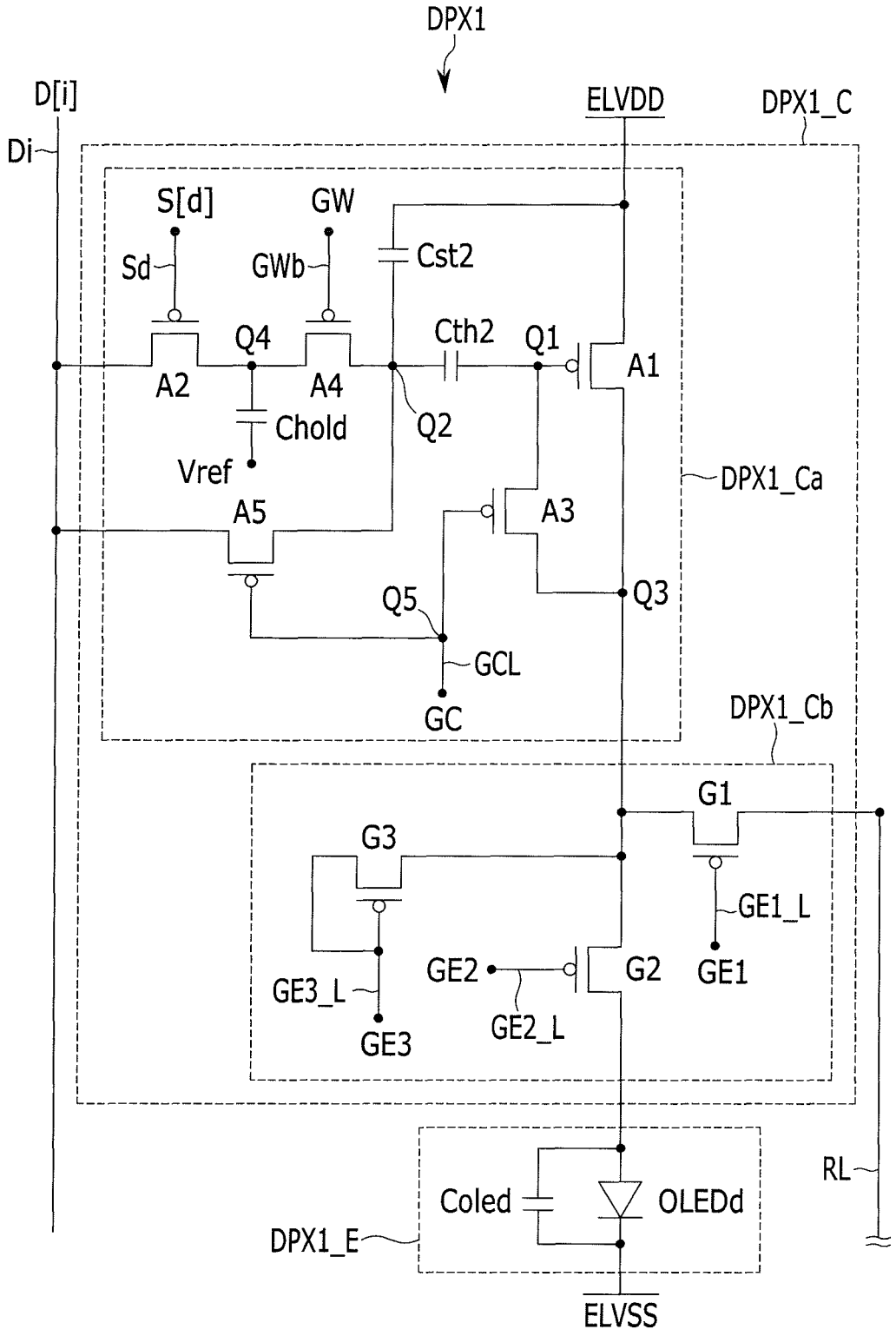
FIG. 5 is a circuit diagram of the structure of a dummy pixel of a display device according to another exemplary embodiment.

FIG. 5 is a circuit diagram of a dummy pixel structure of a display device according to another exemplary embodiment.

A dummy pixel PDX1 according to the exemplary embodiment of FIG. 5 is formed of a driving circuit DPX1_C and a light emission portion DPX1_E of the dummy pixel.

The driving circuit DPX1_C of the dummy pixel is connected with a repair line RL by a laser short when a defective pixel is detected in the pixel unit 101 of the display unit and is thus electrically connected with the light emission portion of the defective pixel.

In addition, the driving circuit DPX1_C of the dummy pixel may be formed of a first driver, that is, a light emission driver DPX1_Ca and a second driver, that is, a repair driver DPXc_Cb.

The light emission driver DPX1_Ca is a circuit that generates and transmits a driving current of a data voltage for light emission by activating the corresponding dummy pixel DPX1.

In addition, when a defective pixel is generated in the pixel unit 101, the repair driver DPX1_Cb is a circuit that compensates for a failure of the defective pixel by being connected with the repair line by a laser short in the corresponding dummy pixel DPX1.

In the display device according to the exemplary embodiment, the structure of each of the plurality of pixels included in the pixel unit 101 is not illustrated, but each of the plurality of pixels may have the same structure as the dummy pixel DPX1, excluding the repair driver DPX1_Cb. That is, each of the plurality of pixels forming the pixel unit to display an image according to an image signal has a structure in which the light emission driver DPX1_Ca and the light emission portion DPX1_E of the dummy pixel DPX1 are connected with each other.

In FIG. 5, the structure of the repair driver DPX1_Cb and the light emission portion DPX1_E of the dummy pixel DPX1 is the same as that of FIG. 3, and therefore no further description thereof will be provided.

In FIG. 5, the light emission driver DPX1_Ca of the dummy pixel DPX1 will be described.

Referring to FIG. 5, the light emission driver DPX1_Ca of the dummy pixel DPX1 includes a driving transistor A1, a switching transistor A2, a compensation transistor A3, a relay transistor A4, a sustain transistor A5, a storage capacitor Cst2, a sustain capacitor Chold, and a compensation capacitor Cth2.

The driving transistor A1 includes a gate electrode connected to a first node Q1, a first electrode connected to the first power source voltage ELVDD, and a second electrode connected to a third node Q3. The driving transistor A1 generates the corresponding driving current according to a data voltage that depends on an image data signal transmitted to the first node Q1 and transmits the driving current to an organic light-emitting diode of the light emission portion.

The switching transistor A2 includes a gate electrode connected to the corresponding scan line Sd among the plurality of scan lines, a first electrode connected to the corresponding data line Di among the plurality of data lines, and a second electrode connected to a fourth node Q4.

The switching transistor A2 is turned on by the scan signal S[d] having a pulse voltage of a gate-on level transmitted through the scan line Sd and transmits a data voltage D[i] that depends on the image data signal transmitted through the data line Di to the fourth node Q4. The fourth node Q4 is connected with the first electrode of the sustain capacitor Chold, and a second electrode of the sustain capacitor Chold is connected with a voltage supply line applying a predetermined reference voltage Vref. Thus, the sustain capacitor Chold stores a voltage value according to a difference between the data voltage D[i] transmitted to the fourth node Q4 and the reference voltage Vref to thereby perform the function of sustaining the data voltage D[i] according to the image data signal transmitted through the data line Di.

The relay transistor A4 includes a gate electrode connected to a second control line GWL, a first electrode connected to the fourth node Q4, and a second electrode connected to the second node Q2. The relay transistor A4 is turned on by a second control signal GW having a pulse voltage of a gate-on level transmitted through the second control line GWL and transmits the data voltage D[i] applied to the fourth node Q4 and maintained therein to the second node Q2.

The second node Q2 is connected with the first electrode of the storage capacitor Cst2, and a second electrode of the storage capacitor Cst2 is connected to the first power source voltage ELVDD. Thus, the storage capacitor Cst2 stores a voltage value according to a difference between the data voltage D[i] transmitted to the second node Q2 and the first power source voltage ELVDD during a predetermined period to thereby maintain the data voltage D[i] for a predetermined period.

Meanwhile, the compensation transistor A3 includes a gate electrode connected to a first control line GCL, a first electrode connected to the first node Q1, and a second electrode connected to the third node Q3.

The compensation transistor A3 is turned on by the first control signal GC having a pulse voltage of a gate-on level transmitted through the first control line GCL and diode-connects the gate electrode of the driving transistor A1 and the second electrode thereof. Thus, in the equation for calculating the amount of driving current that depends on the data voltage applied to the gate electrode terminal of the driving transistor M1, the threshold voltage of the driving transistor is removed to eliminate and compensate for a threshold voltage deviation of the driving transistors of the pixels included in the display unit.

The compensation capacitor Cth2 includes a first electrode connected to the first node Q1 and a second electrode connected to the second node Q2. Since the compensation capacitor Cth2 sustains a voltage difference at lateral ends thereof, a voltage value which depends on the threshold voltage of the driving transistor applied to the first node Q1 is maintained during a compensation period of the driving transistor.

Moreover, the sustain transistor A5 includes a gate electrode connected to the first control line GCL, a first electrode connected to the corresponding data line Di among the plurality of data lines, and a second electrode connected to the second node Q2.

The sustain transistor A5 is substantially simultaneously turned on with the compensation transistor A3 by the first control signal GC having a pulse voltage of a gate-on voltage transmitted through the first control line GCL. The sustain transistor A5 maintains a voltage of the second node N2 by applying a predetermined voltage through the data line Di.

The transistors forming the dummy pixel DPX1 of FIG. 5 are PMOS transistors, but are not limited thereto. The transistors may alternatively be formed as NMOS transistors.

Figure 6:
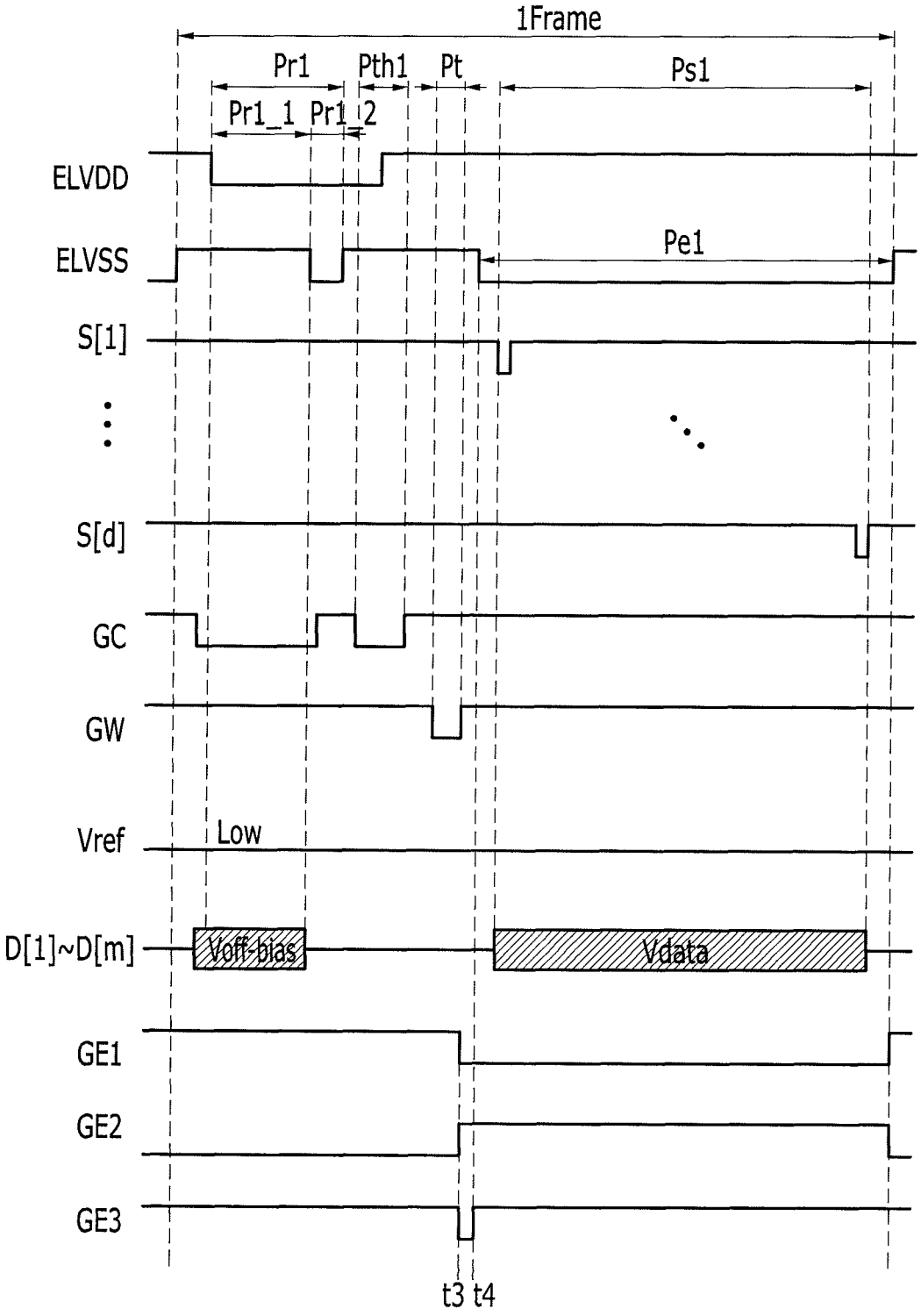
FIG. 6 is a timing diagram provided for describing a method for driving the display device and a method for driving the dummy pixel according to the exemplary embodiment of FIG. 5.

A driving diagram for a display unit including the plurality of dummy pixels DPX1 having the circuit structure of FIG. 5 and a plurality of pixels formed of the circuit structure of the dummy pixel DPX1, excluding the repair driver DPX1 Cb, is as shown in FIG. 6.

Referring to the timing diagram of FIG. 6, one frame period for displaying one image in the display unit 10 includes a reset period Pr1 including of a first reset period Pr1_1 and a second reset period Pr1_2, a compensation period Pth1 for compensating a threshold voltage of the driving transistor of each pixel, a transmission period Pt for transmitting a data voltage according to the corresponding image data signal transmitted from a previous frame (hereinafter, referred to as a previous frame data voltage) to the second node Q2 for light emission, a scan period Ps1 for transmitting a data voltage corresponding to the present frame (hereinafter, referred to as a present frame data voltage) to each of the plurality of pixels, and a light emission period Pe1 for substantially simultaneous light emission of the plurality of pixels with a driving current that depends on the previous frame data voltage.

A driving method according to the exemplary embodiment of FIG. 6 performs each driving step by controlling the level of a power source voltage and controls the entirety of the pixels to substantially simultaneously emit light. In addition, according to the driving method, a data voltage according to an image data signal of the corresponding frame is programmed at substantially the same time as the light emission of each pixel. That is, scanning and light emission operations may be substantially simultaneously performed in one pixel.

In further detail, during the first reset period Pr1_1 of the reset period Pr1, the first power source voltage ELVDD is applied as a low level voltage and the second power source voltage ELVSS is applied as a high level voltage. In this case, the first control signal GC is applied as a low-level gate-on voltage.

The compensation transistor A3 and the sustain transistor A5 are turned on by the first control signal GC. While the compensation transistor A3 is turned on, the gate electrode and the second electrode of the driving transistor A1 are connected to each other.

While the sustain transistor A5 is turned on, a voltage applied to the corresponding data line Di is transmitted to the second node Q2. In this case, a predetermined off-bias voltage Voff-bias is applied to the data line Di and the voltage of the second node Q2 is reset to the off-bias voltage Voff-bias. The value of the predetermined off-bias voltage Voff-bias may be a predetermined low-level voltage, but is not limited thereto. The entirety of the pixels of the display unit 10 apply the off-bias voltage to the second node Q2 during the first reset period Pr1, and therefore a voltage value corresponding to the data voltage stored in the storage capacitor Cst2 connected to the second node Q2 for light emission in the previous frame is reset.

When the voltage of the second node Q2 is reset to the off-bias voltage Voff-bias, the voltage of the first node Q1 is altered corresponding to voltage variation of the second node Q2 due to coupling by the compensation capacitor Cth2. Then, the driving transistor A1 may be turned on. Accordingly, current flow from the first power source voltage ELVDD toward the third node Q3 such that the voltage of the third node Q3 is decreased. That is, the anode voltage of the organic light-emitting diode OLEDd is reset to a low-level voltage.

Such a resetting can be performed in the dummy pixel DPX1 because the second repair control signal GE2 is transmitted as a low-level voltage during the reset period Pr1 and thus the second repair transistor G2 of the repair driver DPX1_Cb can be turned on and accordingly a connection path may be formed with the anode of the organic light-emitting diode OLEDd from the third node Q3.

In addition, during the second reset period Pr1_2 of the reset period Pr1, the first power source voltage ELVDD is applied while being maintained at a low-level voltage and the second power source voltage is altered from to a low level from a high level. In this case, the second control signal GC is changed to a gate-off voltage which is a high level voltage and then applied. Thus, in accordance with the gate-off voltage of the second control signal GC, the compensation transistor A3 and the sustain transistor A5 are turned off. As the second power source voltage ELVSS is altered to the low level voltage, the voltage of the third node Q3 is reset to a further lower voltage due to coupling by the capacitor Coled of the organic light-emitting diode OLEDd.

During the compensation period Pth1, the first power source voltage ELVDD and the second power source voltage ELVSS are applied as high level voltages. In this case, the first control signal GC is applied as a low-level gate-on voltage. The compensation transistor A3 and the sustain transistor A5 are turned on by the first control signal GC. In this case, a predetermined sustain voltage may be applied to the data line Di. The sustain voltage may be the same as or similar to the off-bias voltage Voff-bias. As the sustain transistor A5 is turned on, a sustain voltage is applied to the second node Q2. As the compensation transistor A3 is turned on, the driving transistor A1 is diode-connected and a threshold voltage of the driving transistor A1 is transmitted to the first node Q1. Accordingly, a voltage corresponding to the threshold voltage of the driving transistor A1 is stored in the compensation capacitor Cth2 and thus the threshold voltage of the driving transistor A1 is compensated for. In this case, since the second power source voltage ELVSS is applied as a high-level voltage, the organic light-emitting diode OLEDd does not emit light.

In addition, during the transmission period Pt, the first power source voltage ELVDD and the second power source voltage ELVSS are applied as high level voltages. In this case, the second control signal GW is applied as a low-level gate-on voltage. The relay transistor A4 is turned on by the second control signal GW. As the relay transistor A4 is turned on, the fourth node Q4 and the second node Q2 are connected and a voltage stored in the sustain capacitor Chold is transmitted to the second node Q2. A data voltage applied from the previous frame is stored in the sustain capacitor Chold. That is, the data voltage applied from the previous frame is transmitted to the second node Q2. As the data voltage is transmitted to the second node Q2, the voltage of the first node Q1 is altered in accordance with the fluctuation of the voltage of the second node Q2 to the data voltage due to coupling by the compensation capacitor Cth2. That is, the data voltage corresponding to the previous frame is applied to the first node Q1.

After transmission of the data voltage of the previous frame to the second node Q2, the second control signal GW is increased to a high-level gate-off voltage and then applied, and the connection between the fourth node Q4 and the second node Q2 is disconnected.

During the scan period Ps1, a plurality of scan signals S[1] to S[d] of a low-level gate-on voltage are sequentially applied to the respective corresponding scan lines, and a plurality of data voltages D[1] to D[m] are applied correspondingly. Here, the plurality of data voltages D[1] to D[m] are data voltages that depend on an image data signal corresponding to the present frame.

In the case of the dummy pixel of FIG. 5, the switching transistor A2 is turned on by the scan signal S[d] of the gate-on voltage, and the data voltage D[i] applied to the data line Di is transmitted to the fourth node Q4 through the turned-on switching transistor A2. Accordingly, the data voltage D[i] is stored in the sustain capacitor Chold. The data voltage D[i] stored in the sustain capacitor Chold is used for light emission of the next frame.

Since a predetermined reference voltage Vref is applied to the second electrode of the sustain capacitor Chold, the sustain capacitor Chold stores and maintains a data voltage of the present frame by storing a voltage value according to a voltage difference applied to lateral electrodes thereof. Referring to FIG. 6, the predetermined reference voltage Vref may be set to a low-level voltage.

In addition, during the light emission period Pe1, the second power source voltage ELVSS is altered to a low-level voltage and is then applied while the first power source voltage ELVDD is applied as a high-level voltage. When the second power source voltage ELVSS is applied as the low level voltage, the driving transistor A1 is turned on and a driving current flows to the organic light-emitting diode OLEDd from the first power source voltage ELVDD. The driving current flowing to the organic light-emitting diode OLEDd corresponds to the data voltage of the previous frame applied to the first node Q1. Then, the organic light-emitting diode OLEDd emits light corresponding to the driving current. During the light emission period Pe1, the plurality of pixels of the display unit 10 substantially simultaneously emit light.

Referring to FIG. 6, the length of the light emission period Pe1 may be longer than the length of the scan period Ps1. The length of the light emission period Pe1 may be controlled by controlling the time during which the second power source voltage ELVSS is applied as a low level voltage in one frame.

In this case, the light emission period Pe1 and the scan period Ps1 may overlap in time. That is, the light emission period Pe1 and the scan period Ps1 may be partially or wholly overlapped with each other in time by controlling the length of the light emission period Pe1.

In the driving method of FIG. 6, a driving timing of first to third repair control signals GE1 to GE3 for each period is the same as that of FIG. 4.

In addition, corresponding to the first to third repair control signals GE1 to GE3, the roles and functions of the first to third repair transistors G1 to G3 of the repair driver DPX1_Cb of each dummy pixel are the same as shown in FIG. 4.

That is, during the periods Pr1, Pth1, and Pt before the light emission period Pe1, the first and third repair control signals GE1 and GE3 transmitted to the repair driver DPX1_Cb of each of the plurality of dummy pixels are applied as high level voltages, and the second repair control signal GE2 is applied as a low level voltage.

In addition, during the light emission period Pe1, the second and third repair control signals GE2 and Ge3 are applied as high level voltages and the first repair control signal GE1 is applied as a low level voltage.

Thus, during the light emission period Pe1, the second repair transistor G2 is maintained in the turn-off state so that a driving current can be prevented from flowing to the organic light-emitting diode OLEDd of the dummy pixel, thereby preventing the organic light-emitting diode OLEDd from emitting light.

Meanwhile, the third repair control signal GE3 is transmitted as a low level voltage during a period from a time t3 to a time t4 before the start of the light emission period Pe1. In addition, the third repair transistor G3 is turned on during the period from the time t3 to the time t4. The third repair transistor G3 diode-connects the gate electrode thereof to initialize a driving voltage of an organic light-emitting diode of the previous frame stored in the repair line RL to a driving voltage of an organic light-emitting diode that is going to emit light.

During the light emission period Pe1, the first repair transistor G1 of the repair driver DPX1-Cb of each dummy pixel is turned on and a driving current is transmitted to a light emission portion, that is, an organic light-emitting diode of a defective pixel among the plurality of pixels included in the pixel unit 101 through the repair line RL electrically connected by a laser short such that the defective pixel can be driven as a normal pixel.

Figure 7:
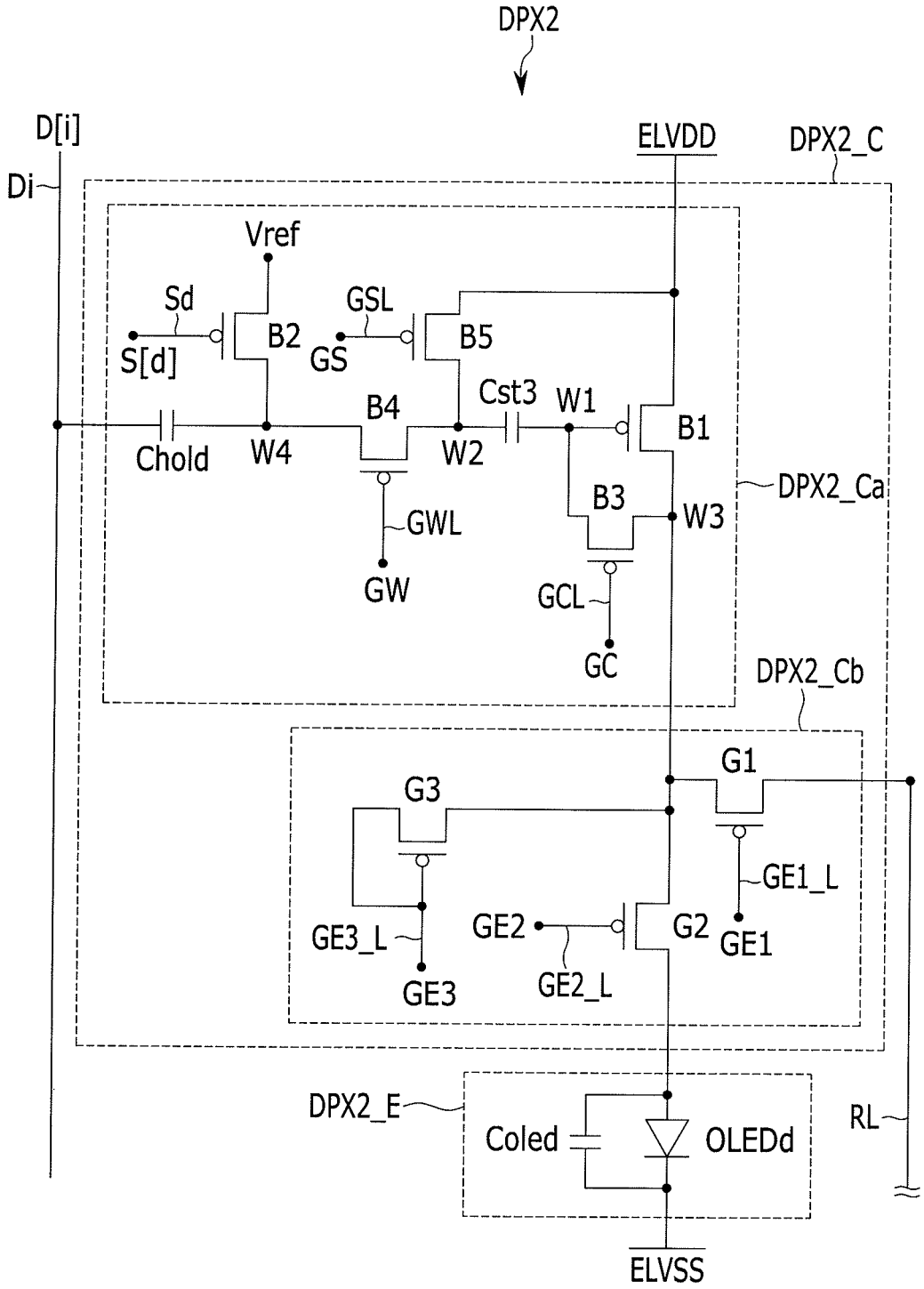
FIG. 7 is a circuit diagram of the structure of a dummy pixel according to another exemplary embodiment.

FIG. 7 is a circuit diagram of a dummy pixel structure of a display device according to another exemplary embodiment.

Like the dummy pixels of the above-described exemplary embodiments, a dummy pixel DPX2 according to the exemplary embodiment of FIG. 7 is formed of a driving circuit DPX2_C and a light emission portion DPX2_E.

The driving circuit DPX2_C of the dummy pixel is formed of a light emission driver DPX2_Ca and a repair driver DPX2_Cb. Since only the structure of the light emission driver DPX2_Ca is different from the dummy pixels of the above-described exemplary embodiments, the structure of the light emission driver DPX2_Ca of the dummy pixel DPX2 will be described hereinafter.

Referring to FIG. 7, the light emission driver DPX2_Ca of the dummy pixel DPX2 includes a driving transistor B1, a switching transistor B2, compensation transistor B3, a relay transistor B4, a sustain transistor B5, a storage capacitor Cst3, and a sustain capacitor Chold.

The driving transistor B1 includes a gate electrode connected to a first node W1, a first electrode connected to a first power source voltage ELVDD, and a second electrode connected to a third node W3. The driving transistor B1 generates a driving current corresponding to a data voltage that depends on an image data signal transmitted to the first node W1 and transmits the driving current to an organic light-emitting diode OLEDd of a light emission portion.

The switching transistor B2 includes a gate electrode connected to the corresponding scan line Sd among the plurality of scan lines, a first electrode connected to a power supply which supplies a predetermined reference voltage Vref, and a second electrode connected to a fourth node W4.

The switching transistor B2 is turned on by a scan signal S[d] having a pulse voltage of a gate-on level transmitted through the scan line Sd and transmits the predetermined reference voltage Vref to the fourth node W4. The fourth node W4 is connected with a first electrode of the sustain capacitor Chold, and a second electrode of the sustain capacitor Chold is connected to a data line Di. Thus, the sustain capacitor Chold stores a voltage that depends on a voltage difference between a data voltage D[i] that depends the corresponding image data signal supplied through the data line Di and the reference voltage Vref transmitted to the fourth node W4 and thus maintains the data voltage D[i].

The relay transistor B4 includes a gate electrode connected to a second control line GWL, a first electrode connected to the fourth node W4, and a second electrode connected to the second node W2. The relay transistor B4 is turned on by a second control signal GW of a gate-on voltage transmitted through the second control line GWL and transmits the data voltage D[i] stored in the sustain capacitor Chold to the second node W2.

A first electrode of the storage capacitor Cst3 is connected to the second node W2, and a second electrode of the storage capacitor Cst3 is connected to the first node W1. Thus, a voltage applied to the first node W1 is altered corresponding to voltage variation of the second node W2 due to coupling of the storage capacitor Cst3.

The sustain transistor B5 includes a gate electrode connected to a third control line GSL, a first electrode connected to the first power source voltage ELVDD, and a second electrode connected to the second node W2.

The sustain transistor B5 is turned on by a third control signal GS having a pulse voltage of a gate-on level transmitted through the third control line GSL and transmits the first power source voltage ELVDD to the second node W2.

Meanwhile, the compensation transistor B3 includes a gate electrode connected to the first control line GCL, a first electrode connected to the first node W1, and a second electrode connected to the third node W3.

The compensation transistor B3 is turned on by the first control signal GC having a pulse voltage of a gate-on level transmitted through the first control line GCL and diode-connects the gate electrode and the second electrode of the driving transistor B1. Thus, in the equation for calculating the amount of driving current that depends on the data voltage applied to a gate electrode terminal of the driving transistor B1, a threshold voltage of the driving transistor is removed to eliminate and compensate for a threshold voltage deviation of the driving transistor for each of the pixels included in the display unit.

The type of the transistors forming the dummy pixel DPX2 of FIG. 7 may be PMOS transistors, but are not limited thereto. The transistors may be formed as NMOS transistors.

Figure 8:
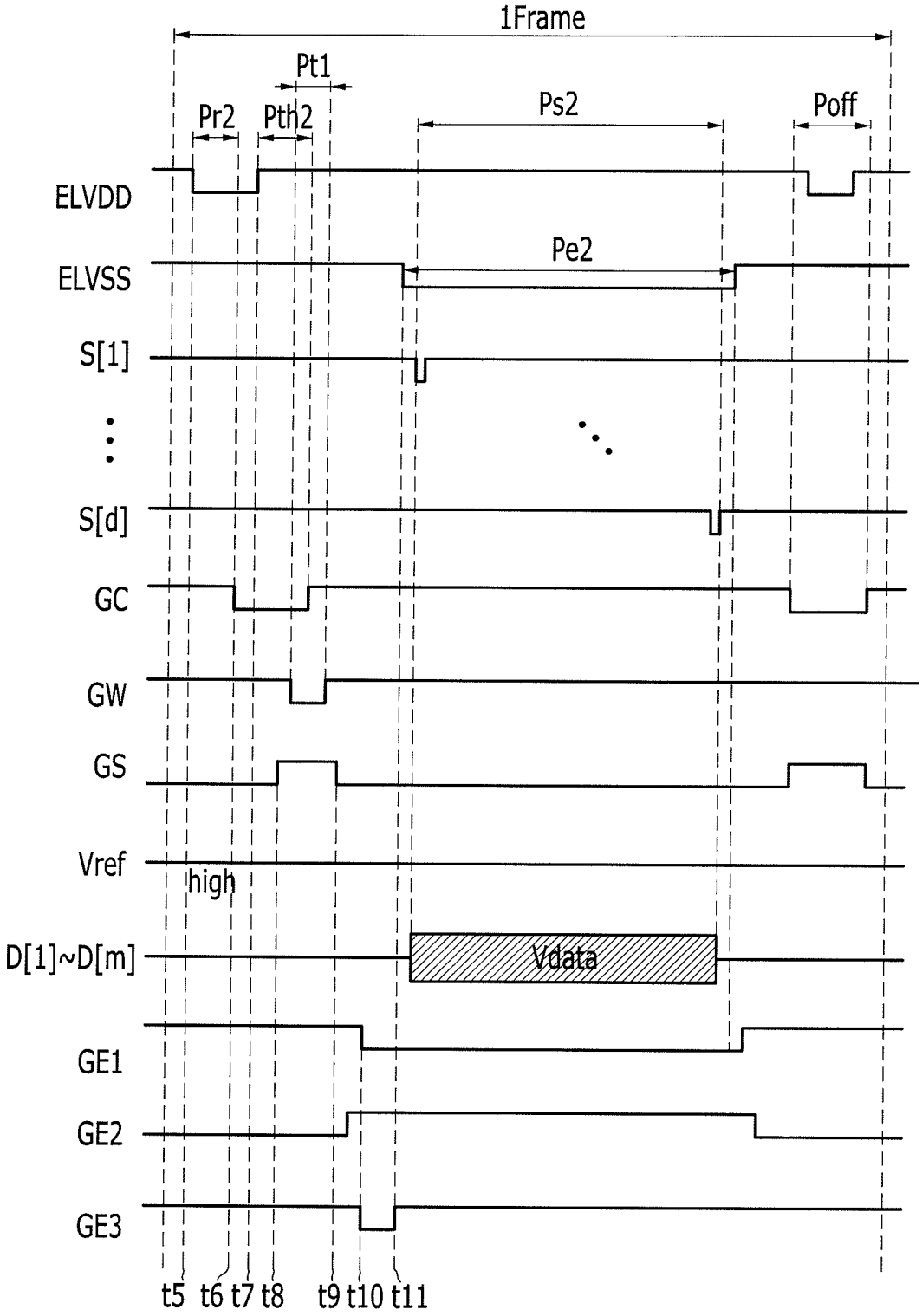
FIG. 8 is a timing diagram provided for describing a method for driving the display device and a method for driving the dummy pixel according to the exemplary embodiment of FIG. 7.

FIG. 8 shows a driving diagram of a display unit including the plurality of dummy pixels DPX2 having the circuit structure of FIG. 7 and a plurality of typical pixels formed of a circuit structure of the dummy pixel DPX2, excluding the repair driver DPX2_Cb.

Referring to the timing diagram of FIG. 8, one frame period during which one image is displayed in a display unit 10 includes a reset period Pr2, a compensation period Pth2 for compensating for a threshold voltage of the driving transistor of each pixel, a transmission period Pt1 for transmitting the data voltage of the previous frame to the second node W2, a scan period Ps2 for transmitting the data voltage of the present frame to each of the plurality of pixels, a light emission period Pe2 during which the plurality of pixels substantially simultaneously emit light according to the driving current that depends on the data voltage of the previous frame, and a bias period Poff during which a response waveform of each pixel is improved.

During the reset period Pr2 from a time t5 to a time t6, the first power source voltage ELVDD is applied as a low level voltage and the second power source voltage ELVSS is applied as a high level voltage. During this period, the third control signal GS is transmitted as a low-level gate-on voltage and thus the sustain transistor B5 is turned on. Thus, a low-level first power source voltage ELVDD is applied to the second node W2. The variation of the voltage applied to the second node W2 changes the voltage of the first node W1 due to coupling of the storage capacitor Cst3. Thus, the driving transistor B1 is turned on and a current flows toward the third node W3 from the first power source voltage ELVDD. Then, the voltage of the third node W3 is decreased to the low level voltage of the first power source voltage ELVDD. That is, an anode voltage of an organic light-emitting diode OLEDd is reset to a low level voltage.

At the time t6, the first control signal GC is decreased to a low level from a high level, and then maintained at the low level during the compensation period Pth2.

During this period, the first power source voltage ELVDD and the second power source voltage ELVSS are applied as high level voltages.

The compensation transistor B3 is turned on by the first control signal GC. While the compensation transistor B3 is turned on, the driving transistor B1 is diode-connected and the threshold voltage of the driving transistor B1 is applied to the first node W1. Accordingly, a voltage corresponding to the threshold voltage of the driving transistor B1 is stored in the storage capacitor Cst3. That is, the threshold voltage of the driving transistor B1 is compensated for.

Meanwhile, while the threshold voltage of the driving transistor is being compensated for, the third control signal GS is increased to high level from low level at a time t8 and maintains the high-level pulse voltage until a time t9.

During a period from the time t8 to time t9, the sustain transistor B5 is turned off in accordance with the third control signal GS. In addition, during the transmission period Pt1 within the period from the time t8 to the time t9, the second control signal GW is transmitted as a low-level gate-on voltage.

The relay transistor B4 is turned on by the second control signal GW of the gate-on voltage. As the relay transistor B4 is turned on, the fourth node W4 and the second node W2 are connected, and the data voltage of the previous frame, stored in the sustain capacitor Chold is transmitted to the second node W2. As the data voltage of the previous frame is transmitted to the second node W2, the voltage of the second node W2 is altered by the voltage stored in the second node W2 due to coupling of the storage capacitor Cst3. In this case, since the second power source voltage ELVSS is applied as a high level voltage, the organic light-emitting diode OLEDd does not emit light.

During the scan period Ps2, a plurality of scan signals S[1] to S[d] of a gate-on voltage are sequentially applied to the plurality of scan lines, and a plurality of data voltages D[1] to D[m] are applied correspondingly. The switching transistor B2 is turned on by the scan signal S[d] of the gate-on voltage, and a predetermined reference voltage Vref is applied to the fourth node W4 through the turn-on switching transistor B2.

During this period, a data voltage D[i] of the present frame is applied to the second electrode of the sustain capacitor Chold through the data line Di. Since the first electrode of the sustain capacitor Chold is connected to the fourth node W4, the sustain capacitor Chold stores a voltage corresponding to a difference between the voltages applied to lateral electrodes thereof during the scan period Ps2.

In this case, since the voltage corresponds to a difference between the data voltage D[i] of the present frame and the reference voltage Vref, the sustain capacitor Chold holds a data voltage according to an image data signal corresponding to the present frame in each pixel.

The data voltage of the present frame, programmed to the sustain capacitor Chold is used for light emission of the next frame.

The light emission period Pe2 is set to a time period during which the second power source voltage ELVSS is altered to a low level voltage and then applied while the first power source voltage ELVDD is applied as a high level voltage. When the second power source voltage ELVSS is applied as a low level voltage, the driving transistor B1 is turned off and a driving current flows to the organic light-emitting diode OLEDd from the first power source voltage ELVDD. The driving current flowing to the organic light-emitting diode OLEDd corresponds to the data voltage of the previous frame, reflected by the voltage of the first node W1. An organic light-emitting diode emits light corresponding to the driving current. Here, each organic light-emitting diode in each of the plurality of pixels included in the pixel unit emits light during the light emission period Pe2, and as in the previous exemplary embodiment, the organic light-emitting diode OLEDd, which is a light emission element for each of the plurality of dummy pixels included in the dummy pixel unit does not emit light during the light emission period Pe2. During the light emission period Pe2, the plurality of pixels (typical pixels) of the pixel unit substantially simultaneously emit light.

During the bias period Poff, the first power source voltage ELVDD is applied as a low level voltage and the second power source voltage ELVSS is applied as a high level voltage. During this period, the first control signal GC is applied as a low level voltage and the third control signal GS is applied as a high level voltage. The compensation transistor B3 is turned on by the first control signal GC and the sustain transistor B5 is turned off by the third control signal GS.

Accordingly, the voltage of the second electrode of the driving transistor B1, that is, the voltage of the third node W3 is applied as a low-level voltage of the first power source voltage ELVDD by the compensation transistor B3 so that the response waveform of the pixel can be improved. The bias period Poff may be omitted as necessary.

In the timing diagram of FIG. 8, the level of a pulse voltage of each of the first to third repair control signals GE1 to GE3 applied to the repair driver DPX2_Cb of the dummy pixel DPX2 is illustrated. The timing of each of the first to third repair control signals GE1 to GE3 in timing diagram of FIG. 8 is the same as the corresponding timing in the timing diagrams of FIG. 4 and FIG. 6. In addition, roles and functions of the first to third repair transistors G1 to G3 of the repair driver DPX2_Cb of the dummy pixel are the same as those described in the previous exemplary embodiments, and therefore no further description will be provided.

Meanwhile, at least one of a plurality of transistors included the dummy pixels DPX, DPX1, and DPX2 and a plurality of typical pixels in the pixel unit may be an oxide thin film transistor (TFT) having a semiconductor formed of an oxide semiconductor.

The oxide semiconductor may include at least one of oxides based on titanium (Ti), hafnium (Hf), zirconium (Zr), aluminum (Al), tantalum (Ta), germanium (Ge), zinc (Zn), gallium (Ga), tin (Sn), or indium (In) and complex oxides thereof, such as zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-talaum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O).

The semiconductor layer includes a channel area in which impurities are not doped and a source/drain area in which impurities are doped at both sides of the channel area. Here, such impurities are selected according to the kind of a thin film transistor used and may be an N-type impurity or a P-type impurity.

When a semiconductor layer is formed with an oxide semiconductor, in order to protect the oxide semiconductor from the environment such as exposure to a high temperature, a separate protection layer may be added.

In addition, an organic emission layer of the organic light-emitting diode OLED may be formed of low polymer organic material or a high polymer organic material such as poly 3,4-ethylenedioxythiophene (PEDOT). Further, the organic emission layer may be formed with a multilayer including at least one of an emission layer, a hole injection layer (HIL), a hole transporting layer (HTL), an electron transporting layer (ETL), and an electron injection layer (EIL). When the organic emission layer includes each of an emission layer, an HIL, an HTL, an ETL, and an EIL, the HIL is disposed on a pixel electrode, which is a positive electrode, and the HTL, the emission layer, the ETL, and the EIL are sequentially stacked thereon.

The organic emission layer may include a red organic emission layer that emits a red color, a green organic emission layer that emits a green color, and a blue organic emission layer that emits a blue color, and the red organic emission layer, the green organic emission layer, and the blue organic emission layer are formed as a red pixel, a green pixel, and a blue pixel, respectively, to embody a color image.

Further, the organic emission layer stacks of the red organic emission layer, the green organic emission layer, and the blue organic emission layer as a red pixel, a green pixel, and a blue pixel and form a red color filter, a green color filter, and a blue color filter on a pixel basis, thereby embodying a color image. In another example, by forming a white organic emission layer that emits white for each of a red pixel, a green pixel, and a blue pixel and by forming a red color filter, a green color filter, and a blue color filter on a pixel basis, a color image may be embodied. When a color image is embodied using a white organic emission layer and a color filter, a deposition mask for depositing a red organic emission layer, a green organic emission layer, and a blue organic emission layer at respective individual pixel, i.e., a red pixel, a green pixel, and a blue pixel may not be used.

The white organic emission layer that is described in another example may be formed in one organic emission layer and includes a configuration that may emit white by stacking a plurality of organic emission layers. For example, the white organic emission layer may include a configuration that may emit white by combining at least one yellow organic emission layer and at least one blue organic emission layer, a configuration that may emit white by combining at least one cyan organic emission layer and at least one red organic emission layer, and a configuration that may emit white by combining at least one magenta organic emission layer and at least one green organic emission layer.

While the described technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, those skilled in the art will understand that various modifications and equivalent other embodiments of the described technology are possible. Consequently, the true technical protective scope of the described technology must be determined based on the technical spirit of the appending claims.

What is claimed is:

1. A display device comprising:

a plurality of pixels, each pixel including i) a driver configured to generate a driving current according to an input image data signal and ii) a light emission portion comprising an organic light-emitting diode configured to emit light according to the driving current; and at least one dummy pixel electrically connected to a repair line that is electrically connected to the light emission portion of at least one first pixel among the pixels, wherein the dummy pixel comprises:

a dummy pixel driver having the same structure as the driver of each of the pixels and configured to generate a driving current;

a dummy pixel light emission portion comprising an organic light-emitting diode; and a repair driver configured to transmit the driving current through the repair line when the driver of the first pixel has failed.

2. The display device of claim 1, wherein the repair driver further comprises:

a first repair transistor configured to be turned on during a light emission period of the pixels to electrically connect the dummy pixel driver to the repair line;

a second repair transistor provided between the dummy pixel driver and the dummy pixel light emission portion and configured to be turned on during a non-light emission period of the pixels and to be turned off during the light emission period of the pixels; and a third repair transistor configured to be turned on during a predetermined period before the light emission period of the pixels to apply an initialization driving voltage to the repair line.

3. The display device of claim 2, wherein the first repair transistor comprises:

a gate electrode electrically connected to a first repair control line configured to transmit a first repair control signal, a first electrode electrically connected to the dummy pixel driver, and a second electrode electrically connected to the repair line.

4. The display device of claim 2, wherein the second repair transistor comprises:

a gate electrode electrically connected to a second repair control line configured to transmit a second repair control signal, a first electrode electrically connected to the dummy pixel driver, and a second electrode electrically connected to the dummy pixel light emission portion.

5. The display device of claim 2, wherein the third repair transistor comprises:

a gate electrode electrically connected to a third repair control line configured to transmit a third repair control signal, a first electrode electrically connected to the dummy pixel driver, and a second electrode electrically connected to the gate electrode of the third repair transistor.

6. The display device of claim 1, wherein, when the driver of the first pixel fails, the light emission portion of the first pixel and the repair line are configured to be electrically connected with each other by a laser short, and wherein the repair line and the repair driver of the dummy pixel are configured to be electrically connected with each other by the laser short.

7. The display device of claim 1, wherein the driver of each of the pixels and the dummy pixel driver each respectively comprise:

a driving transistor including: i) a gate electrode electrically connected to a first node, ii) a first electrode electrically connected to a first power source voltage, and iii) a second electrode electrically connected to a third node;

a switching transistor including: i) a gate electrode electrically connected to a corresponding scan line configured to receive a scan signal, ii) a first electrode electrically connected to a corresponding data line, and iii) a second electrode electrically connected to a second node;

a compensation transistor including: i) a gate electrode electrically connected to a first control line configured to receive a first control signal, ii) a first electrode electrically connected to the first node, and iii) a second electrode electrically connected to the third node;

a storage capacitor including a first electrode electrically connected to the first power source voltage and a second electrode electrically connected to the second node; and a compensation capacitor including a first electrode electrically connected to the first node and a second electrode electrically connected to the second node, and wherein the driver of each of the pixels and the dummy pixel driver are configured to be controlled by a voltage level of the first power source voltage and a voltage level of a second power source voltage, and wherein the second power source voltage is electrically connected to the organic light-emitting diode of each of the pixels and to a cathode of the organic light-emitting diode of the dummy pixel.

8. The display device of claim 7, wherein, while the first power source voltage is applied as a predetermined high level voltage and the second power source voltage is applied as a predetermined low level voltage, the organic light-emitting diodes of the respective pixels are configured to substantially simultaneously emit light and wherein the organic light-emitting diode of the dummy pixel is not configured to emit light.

9. The display device of claim 1, wherein the driver of each of the pixels and the dummy pixel driver each respectively comprise:

a driving transistor including: i) a gate electrode electrically connected to a first node, ii) a first electrode electrically connected to a first power source voltage, and iii) a second electrode electrically connected to a third node;

a switching transistor including: i) a gate electrode electrically connected to a corresponding scan line configured to receive a scan signal, ii) a first electrode electrically connected to a corresponding data line, and iii) a second electrode electrically connected to a fourth node;

a compensation transistor including: i) a gate electrode electrically connected to a first control line configured to receive a first control signal, ii) a first electrode electrically connected to the first node, and iii) a second electrode electrically connected to the third node;

a relay transistor including: i) a gate electrode electrically connected to a second control line configured to receive a second control signal, ii) a first electrode electrically connected to the fourth node, and iii) a second electrode electrically connected to a second node;

a sustain transistor including: i) a gate electrode electrically connected to the first control line, ii) a first electrode electrically connected to the corresponding data line, and iii) a second electrode electrically connected to the second node;

a storage capacitor including a first electrode electrically connected to the first power source voltage and a second electrode electrically connected to the second node;

a compensation capacitor including a first electrode electrically connected to the first node and a second electrode electrically connected to the second node; and a sustain capacitor including a first electrode electrically connected to the fourth node and a second electrode electrically connected to a power supply configured to apply a predetermined reference voltage, and wherein the driver of each of the pixels and the dummy pixel driver are configured to be controlled by a voltage level of the first power source voltage and a voltage level of a second power source voltage, wherein the second power source voltage is electrically connected to the organic light-emitting diode of each of the pixels and to a cathode of the organic light-emitting diode of the dummy pixel.

10. The display device of claim 9, wherein, while the first power source voltage is applied as a predetermined high level voltage and the second power source voltage is applied as a predetermined low level voltage, the organic light-emitting diodes of the respective pixels are configured to substantially simultaneously emit light and wherein the organic light-emitting diode of the dummy pixel is not configured to emit light.

11. The display device of claim 9, wherein, while the first power source voltage is applied as a predetermined high level voltage and the second power source voltage is applied as a predetermined low level voltage, scan signals corresponding to the gate electrodes of the switching transistors of the respective drivers of the pixels and the dummy pixel driver are configured to sequentially receive a gate-on voltage.

12. The display device of claim 1, wherein the drivers of the pixels and the dummy pixel driver each respectively comprise:

a driving transistor including: i) a gate electrode electrically connected to a first node, ii) a first electrode electrically connected to a first power source voltage, and iii) a second electrode electrically connected to a third node;

a switching transistor including: i) a gate electrode electrically connected to a corresponding scan line configured to receive a scan signal, ii) a first electrode electrically connected to a power supply configured to apply a predetermined reference voltage, and iii) a second electrode electrically connected to a fourth node;

a compensation transistor including: i) a gate electrode electrically connected to a first control line configured to receive a first control signal, ii) a first electrode electrically connected to the first node, and iii) a second electrode electrically connected to the third node;

a relay transistor including: i) a gate electrode electrically connected to a second control line configured to receive a second control signal, ii) a first electrode electrically connected to the fourth node, and iii) a second electrode electrically connected to a second node;

a sustain transistor including: i) a gate electrode electrically connected to a third control line configured to receive a third control, ii) a first electrode electrically connected to the first power source voltage, and iii) a second electrode electrically connected to the second node;

a storage capacitor including a first electrode electrically connected to the first node and a second electrode electrically connected to the second node; and a sustain capacitor including a first electrode electrically connected to the corresponding data line and a second electrode electrically connected to the fourth node, and wherein the driver of each of the pixels and the dummy pixel driver are configured to be controlled by a voltage level of the first power source voltage and a voltage level of a second power source voltage, wherein the second power source voltage is electrically connected to the organic light-emitting diode of each of the pixels and to a cathode of the organic light-emitting diode of the dummy pixel.

13. The display device of claim 12, wherein, while the first power source voltage is applied as a predetermined high level voltage and the second power source voltage is applied as a predetermined low level voltage, the organic light-emitting diodes of the respective pixels are configured to substantially simultaneously emit light and wherein the organic light-emitting diode of the dummy pixel is not configured to emit light.

14. The display device of claim 12, wherein, while the first power source voltage is applied as a predetermined high level voltage and the second power source voltage is applied as a predetermined low level voltage, scan signals corresponding to the gate electrodes of the switching transistors of the respective drivers of the pixels and the dummy pixel driver are configured to sequentially receive a gate-on voltage.

15. The display device of claim 1, wherein the display device comprises:

a display unit including the pixels and the dummy pixel;

a scan driver configured to transmit a plurality of scan signals corresponding to the pixels and the dummy pixel;

a data driver configured to transmit a plurality of image data signals corresponding to the pixels and the dummy pixel;

a power supply configured to supply a plurality of power source voltages and a predetermined reference voltage for driving the pixels and the dummy pixel;

a compensation control signal unit configured to transmit a plurality of control signals that control operations of the drivers of the pixels and the dummy pixel driver;

a repair control signal unit configured to transmit a plurality of repair control signals that control operation of the repair driver; and a signal controller configured to i) generate and transmit a plurality of driving control signals that control the scan driver, the data driver, the power supply, the compensation control signal unit, and the repair control signal unit, ii) process an external image signal, and iii) transmit the image data signal to the data driver.

16. A pixel comprising:

a first driver comprising: i) a driving transistor configured to generate a driving current according to an image data signal, ii) a switching transistor configured to activate an external pixel corresponding to a scan signal, iii) a compensation transistor configured to compensate for a threshold voltage of the driving transistor, iv) a storage capacitor configured to store a voltage corresponding to the image data signal, and v) a compensation capacitor configured to store the threshold voltage of the driving transistor during a predetermined period;

a first light emission portion including an organic light-emitting diode; and a repair driver provided between a first electrode of the driving transistor and a repair line electrically connected to an organic light-emitting diode of the external pixel, wherein the repair driver comprises: i) a first repair transistor configured to transmit the driving current to the organic light-emitting diode of the external pixel, ii) a second repair transistor formed between the first driver and the first light emission portion, and iii) a third repair transistor electrically connected to the first driver and configured to apply an initialization driving voltage to the repair line.

17. A pixel comprising:

a driver comprising: i) a driving transistor configured to generate a driving current according to an image data signal, ii) a switching transistor configured to activate an external pixel corresponding to a scan signal, iii) a compensation transistor configured to compensate for a threshold voltage of the driving transistor, iv) a relay transistor configured to transmit a voltage corresponding to a data voltage of a previous frame, v) a sustain transistor configured to transmit a predetermined voltage applied through a corresponding data line in substantial synchronization with a switching operation of the compensation transistor, vi) a sustain capacitor configured to store a voltage corresponding to a data voltage of a present frame corresponding to the switching operation of the switching transistor, vii) a storage capacitor configured to store a voltage corresponding to the data voltage of the previous frame received from the relay transistor, and viii) a compensation capacitor configured to store the threshold voltage of the driving transistor;

a light-emitting portion including an organic light-emitting diode; and a repair driver provided between a first electrode of the driving transistor and a repair line electrically connected to an organic light-emitting diode of the external pixel, wherein the repair driver comprises: i) a first repair transistor configured to transmit a driving current to the organic light-emitting diode of the external pixel, ii) a second repair transistor formed between a second driver and a second light emission portion, and iii) a third repair transistor electrically connected to the second driver and configured to apply an initialization driving voltage to the repair line.

18. A pixel comprising:

a driver comprising: i) a driving transistor configured to generate a driving current according to an image data signal, ii) a switching transistor configured to activate an external pixel corresponding to a scan signal, iii) a compensation transistor configured to compensate for a threshold voltage of the driving transistor, iv) a relay transistor configured to transmit a voltage corresponding to a data voltage of a previous frame, v) a sustain transistor configured to transmit a first power source voltage to a gate electrode terminal of the driving transistor, vi) a sustain capacitor configured to receive and store a voltage corresponding to a data voltage of the previous frame through a corresponding data line, and vii) a storage capacitor configured to store the voltage corresponding to the data voltage of the previous frame transmitted through the relay transistor;

a light emission portion including an organic light-emitting diode; and a repair driver provided between a first electrode of the driving transistor and a repair line electrically connected to an organic light-emitting diode of the external pixel, wherein the repair driver comprises: i) a first repair transistor configured to transmit a driving current to the organic light-emitting diode of the external pixel, ii) a second repair transistor formed between a third driver and a third light emission portion, and iii) a third repair transistor electrically connected to the third driver and configured to apply an initialization driving voltage to the repair line.

19. A method for driving a display device including a plurality of pixels and at least one dummy pixel, each of the pixels comprising: i) an organic light-emitting diode, ii) a driving transistor configured to generate a driving current according to an image data signal, iii) a switching transistor configured to respond to a scan signal, iv) a compensation transistor configured to compensate for a threshold voltage of the driver transistor, v) a storage capacitor configured to store a voltage corresponding to the image data signal, and vi) a compensation capacitor configured to store the threshold voltage of the driving transistor, wherein the dummy pixel has substantially the same structure as each of the pixels and includes a repair driver electrically connected with a repair line that is electrically connected to an organic light-emitting diode of a pixel among the pixels, the method comprising:

applying a first voltage to a gate electrode of the driving transistor through a corresponding data line;

resetting a voltage of a drain electrode of the driving transistor to a low-level first power source voltage;

compensating for the threshold voltage of the driving transistor based at least in part on the compensation transistor being turned on;

transmitting a voltage according to the image data signal through the corresponding data line in response to the corresponding scan signal sequentially transmitted through the switching transistor of each of the pixels and the dummy pixel and storing the voltage in the storage capacitor; and applying a low-level second power source voltage to a cathode of each of the organic light-emitting diodes such that organic light-emitting diodes of the pixels substantially simultaneously emit light in accordance with the driving current, wherein the repair driver of the dummy pixel comprises a first repair transistor configured to transmit a driving current generated from the driving transistor of the dummy pixel to the repair line, and wherein the first repair transistor is configured to be turned on when the organic light-emitting diodes of the pixels substantially simultaneously emit light.

20. The method for driving the display device of claim 19, wherein the repair driver of the dummy pixel further comprises a second repair transistor provided between the driving transistor of the dummy pixel and the organic light-emitting diode of the dummy pixel, and wherein the second repair transistor is configured to be turned on in the applying of the first voltage, the resetting, the compensating, and the scanning, and the second repair transistor is configured to be turned off in the substantially simultaneous light emission of the organic light-emitting diodes.

21. The method of claim 19, wherein the repair driver of the dummy pixel further comprises a third repair transistor, a first electrode of the third repair transistor is electrically connected to the driving transistor of the dummy pixel and the repair line, and a gate electrode and a second electrode of the third repair transistor are electrically connected to each other, and wherein the third repair transistor is configured to be turned on during a predetermined period before the substantially simultaneous light emission to apply an initialization driving voltage to the repair line.

22. A method for driving a display device including a plurality of pixels and at least one dummy pixel, each of the pixels comprising: i) an organic light-emitting diode, ii) a driving transistor configured to generate a driving current according to an image data signal, iii) a switching transistor configured to respond to a scan signal, iv) a compensation transistor configured to compensate for a threshold voltage of the driving transistor, v) a relay transistor configured to transmit a data voltage of a previous frame to a gate electrode terminal of the driving transistor, vi) a sustain capacitor configured to store a data voltage of a present frame received from a corresponding data line, and vii) a storage capacitor configured to store a voltage corresponding to the data voltage of the previous frame, wherein the dummy pixel has substantially the same structure as each of the pixels and includes a repair driver electrically connected to a repair line that is electrically connected to an organic light-emitting diode of at least one pixel of the pixels, the method comprising:

resetting a voltage of a drain electrode of the driving transistor to a low-level first power source voltage;

compensating for the threshold voltage of the driving transistor based at least in part on the compensation transistor being turned on;

transmitting the data voltage of the previous frame stored in the sustain capacitor to the gate electrode terminal of the driving transistor based at least in part on the relay transistor being turned on;

substantially simultaneously emitting light from the organic light-emitting diodes of the pixels in accordance with the driving current according to the data voltage of a previous frame based at least in part on application of a low-level second power source voltage to a cathode of the organic light-emitting diode; and turning on the switching transistors for each of the pixels and the dummy pixel according to sequentially transmitted scan signals substantially at the same time as the substantially simultaneous light emission, and storing the data voltage of the present frame, and wherein the repair driver of the dummy pixel comprises a first repair transistor configured to transmit a driving current generated from the driving transistor of the dummy pixel to the repair line, and wherein the first repair transistor is configured to be turned on during the substantially simultaneous light emission.

23. The method for driving the display device of claim 22, wherein the period of the substantially simultaneous light emission is longer than or equal to the period of the scanning, and wherein the substantially simultaneous light emission and the scanning are overlapped with each other in each of the pixels and the dummy pixel.

24. The method for driving the display device of claim 22, wherein the repair driver comprises:

a second repair transistor provided between the driving transistor of the dummy pixel and an organic light-emitting diode of the dummy pixel, wherein the second repair transistor is configured to be turned on during the resetting, the compensating, and the transmitting, and wherein the second repair transistor is configured to be turned off during the substantially simultaneous light emission and the scanning.

25. The method for driving the display device of claim 22, wherein the repair driver of the dummy pixel further comprises: a third repair transistor, wherein a first electrode of the third repair transistor is electrically connected to the driving transistor of the dummy pixel and the repair line, wherein a gate electrode and a second electrode of the third repair transistor are electrically connected to each other, and wherein the third repair transistor is configured to be turned on during a predetermined period before the substantially simultaneous light emission to apply an initialization driving voltage to the repair line.

* * * * *